US009084484B2

(12) United States Patent
Vilkomirski et al.

(10) Patent No.: US 9,084,484 B2
(45) Date of Patent: Jul. 21, 2015

(54) SHELVING SYSTEM

(75) Inventors: Gil Vilkomirski, Ein Vered (IL); Zvika Fraiman, Havazelet Hasharon (IL)

(73) Assignee: THE STANLEY WORKS ISRAEL LTD., Rosh Ha'Ayin (IL)

( * ) Notice: Subject to any disclaimer, the term of this patent is extended or adjusted under 35 U.S.C. 154(b) by 0 days.

(21) Appl. No.: 13/214,876

(22) Filed: Aug. 22, 2011

(65) Prior Publication Data

US 2013/0048588 A1 Feb. 28, 2013

(51) Int. Cl.
*A47B 87/02* (2006.01)
*A47B 96/02* (2006.01)

(52) U.S. Cl.
CPC ..... *A47B 87/0215* (2013.01); *A47B 87/0223* (2013.01); *A47B 96/027* (2013.01)

(58) Field of Classification Search
CPC ..... A47B 87/0223; A47B 87/0246; A47B 87/0253; A47B 87/0215; A47B 47/05; A47B 47/00; A47B 47/0083; A47B 47/045; A47B 2087/023; A47B 57/265; A47B 96/021; A47B 96/027; A47F 5/005
USPC ..... 211/126.12, 126.15, 153, 186, 187, 211/188; 108/190, 192, 193, 147.15, 108/147.16, 147.11–147.13; 312/330.1, 312/265.1–265.4, 246, 334.23, 334.7, 334.8
See application file for complete search history.

(56) References Cited

U.S. PATENT DOCUMENTS

| | | | | |
|---|---|---|---|---|
| 2,115,130 | A | 4/1938 | Thurn et al. | |
| 2,276,374 | A | 3/1942 | Derman | |
| 2,594,605 | A * | 4/1952 | Zoppelt | 211/123 |
| 2,642,326 | A | 6/1953 | Taylor | |
| 2,915,350 | A | 12/1959 | Sinclair | |
| 2,933,193 | A | 4/1960 | De Mattia | |
| 3,141,423 | A * | 7/1964 | Christensen | 108/190 |
| 3,169,813 | A * | 2/1965 | Cannon et al. | 312/270.3 |
| 3,294,353 | A | 12/1966 | Rowe | |
| 3,337,078 | A | 8/1967 | Radek | |

(Continued)

FOREIGN PATENT DOCUMENTS

| | | |
|---|---|---|
| DE | 3904426.2 | 8/1989 |
| DE | 4213721.7 | 4/1993 |

(Continued)

OTHER PUBLICATIONS

Extended search report, including the search opinion, as issued for European patent application No. 12179732.8, dated Nov. 19, 2012.

*Primary Examiner* — Patrick Hawn

(74) *Attorney, Agent, or Firm* — Pillsbury Winthrop Shaw Pittman LLP

(57) ABSTRACT

A shelving system having tubular frame members and plastic shelves, the shelves having frame receiving regions for receiving ends of the frame members. The shelves and frame members are connectable by insertion of the frame members into the frame receiving regions to form an openly configured, assembled shelving unit in which the shelves are connected to one another in vertically spaced relationship by the frame members. The shelving system has at least one closure member. The assembled shelving system and the at least one closure member both have an integrally molded connector structure. The integrally molded connector structures enable the at least one molded plastic closure member to be connected to the assembled shelving unit after the shelving unit has been assembled.

18 Claims, 32 Drawing Sheets

(56) References Cited

U.S. PATENT DOCUMENTS

| | | | | | |
|---|---|---|---|---|---|
| 3,416,282 | A | | 12/1968 | Daugherty | |
| 3,497,127 | A | | 2/1970 | Box | |
| 3,636,893 | A | * | 1/1972 | Lange | 108/190 |
| 3,664,274 | A | * | 5/1972 | Bustos | 108/147.13 |
| 3,675,808 | A | | 7/1972 | Brink | |
| 3,730,601 | A | * | 5/1973 | Misenheimer, III | 312/108 |
| 3,759,600 | A | | 9/1973 | MacDonald | |
| 3,955,863 | A | | 5/1976 | Yellin | |
| 3,964,810 | A | | 6/1976 | Murphy | |
| 4,024,686 | A | * | 5/1977 | Gronert | 52/761 |
| 4,050,386 | A | | 9/1977 | Kellogg | |
| 4,138,953 | A | * | 2/1979 | Tashman | 108/147.13 |
| 4,140,355 | A | * | 2/1979 | Swain | 312/330.1 |
| 4,145,977 | A | | 3/1979 | Yellin | |
| 4,158,336 | A | * | 6/1979 | Brescia et al. | 108/190 |
| 4,169,639 | A | | 10/1979 | Zola | |
| 4,170,313 | A | | 10/1979 | Caves et al. | |
| 4,241,668 | A | | 12/1980 | Carroll | |
| 4,242,848 | A | | 1/1981 | Schoultz | |
| 4,318,576 | A | * | 3/1982 | Ford | 312/264 |
| 4,503,780 | A | | 3/1985 | Apissomian | |
| 4,558,553 | A | | 12/1985 | Kolk | |
| 4,597,616 | A | * | 7/1986 | Trubiano | 312/246 |
| 4,606,170 | A | | 8/1986 | Mendenhall | |
| 4,662,515 | A | | 5/1987 | Newby, Sr. | |
| 4,703,850 | A | * | 11/1987 | Walker | 206/293 |
| 4,757,769 | A | | 7/1988 | Suttles | |
| 4,792,195 | A | * | 12/1988 | Adriaansen et al. | 312/245 |
| 4,858,413 | A | | 8/1989 | Grushka | |
| 4,887,874 | A | | 12/1989 | Joffe | |
| 4,989,519 | A | | 2/1991 | Welsch et al. | |
| 5,205,630 | A | | 4/1993 | Welch et al. | |
| 5,218,914 | A | * | 6/1993 | Dickinson | 108/64 |
| 5,415,302 | A | | 5/1995 | Carlson et al. | |
| 5,433,518 | A | | 7/1995 | Skov | |
| 5,501,354 | A | * | 3/1996 | Stromberg | 220/7 |
| 5,555,989 | A | | 9/1996 | Moran, Jr. | |
| 5,628,256 | A | | 5/1997 | Lazarus | |
| 5,676,263 | A | | 10/1997 | Chang | |
| 5,706,741 | A | * | 1/1998 | Thorp et al. | 108/193 |
| 5,722,544 | A | | 3/1998 | Williams | |
| 5,881,653 | A | | 3/1999 | Pfister | |
| 5,947,036 | A | | 9/1999 | Cohen | |
| 5,975,660 | A | | 11/1999 | Tisbo et al. | |
| 6,015,053 | A | | 1/2000 | Sheng | |
| 6,056,380 | A | | 5/2000 | Nien | |
| 6,123,035 | A | | 9/2000 | Pfister | |
| 6,135,583 | A | * | 10/2000 | Simon et al. | 312/257.1 |
| 6,185,878 | B1 | | 2/2001 | Bullard, III et al. | |
| 6,202,867 | B1 | | 3/2001 | Di Blasi et al. | |
| 6,386,657 | B1 | * | 5/2002 | Frifeldt | 312/265.1 |
| 6,446,414 | B1 | | 9/2002 | Bullard, III et al. | |
| 6,578,720 | B1 | | 6/2003 | Wang | |
| 6,592,025 | B2 | | 7/2003 | Bazany et al. | |
| 6,695,418 | B2 | | 2/2004 | Skov et al. | |
| 6,712,436 | B2 | | 3/2004 | Chen | |
| 6,726,040 | B1 | * | 4/2004 | Chen | 211/187 |
| 6,752,278 | B2 | | 6/2004 | Craft et al. | |
| 6,764,144 | B2 | | 7/2004 | Insalaco et al. | |
| 6,981,751 | B2 | * | 1/2006 | Powell | 312/265.3 |
| 7,165,821 | B2 | | 1/2007 | Chuan | |
| 7,472,655 | B2 | | 1/2009 | Leng | |
| 7,658,154 | B2 | * | 2/2010 | Yankello et al. | 108/190 |
| 7,731,142 | B2 | | 6/2010 | Chen et al. | |
| 7,765,942 | B2 | * | 8/2010 | Choi | 108/193 |
| 7,798,581 | B2 | | 9/2010 | Chen et al. | |
| 7,832,584 | B2 | | 11/2010 | Eggers et al. | |
| 2003/0146180 | A1 | | 8/2003 | Craft | |
| 2004/0040922 | A1 | * | 3/2004 | Ko | 211/153 |
| 2007/0044692 | A1 | | 3/2007 | Zimmer | |
| 2007/0251426 | A1 | | 11/2007 | Li | |
| 2008/0074021 | A1 | | 3/2008 | Croft et al. | |
| 2008/0116156 | A1 | | 5/2008 | Park | |
| 2008/0149581 | A1 | | 6/2008 | Clarke et al. | |
| 2009/0107942 | A1 | | 4/2009 | Liao | |
| 2009/0242501 | A1 | | 10/2009 | Yankello et al. | |
| 2010/0187960 | A1 | | 7/2010 | Liang | |
| 2010/0295434 | A1 | | 11/2010 | Hightower | |
| 2010/0313529 | A1 | | 12/2010 | Steinhauser | |
| 2012/0074825 | A1 | * | 3/2012 | Armstrong et al. | 312/334.23 |
| 2012/0217858 | A1 | * | 8/2012 | Lai | 312/334.5 |

FOREIGN PATENT DOCUMENTS

| | | | | | |
|---|---|---|---|---|---|
| DE | 29517766.7 | | | 1/1996 | |
| DE | 29914896.3 | | | 12/1999 | |
| DE | 20208948.7 | | | 9/2002 | |
| DE | 202005009310.6 | | | 4/2006 | |
| DE | 102006059748.6 | | | 6/2008 | |
| DE | 202009012235.2 | | | 12/2009 | |
| EP | 0 389 864 | A2 | | 10/1990 | |
| EP | 0 512 256 | A2 | | 11/1992 | |
| EP | 1 029 470 | | | 8/2000 | |
| EP | 1 159 891 | A1 | | 12/2001 | |
| EP | 1 223 351 | A2 | | 7/2002 | |
| FR | 2578298 | A1 | * | 9/1986 | A47B 47/04 |
| GB | 2 215 589 | | | 9/1989 | |
| GB | 2 232 344 | | | 12/1990 | |
| WO | WO 93/24378 | | | 12/1993 | |
| WO | WO 03/065849 | | | 8/2003 | |
| WO | WO 03/079853 | | | 10/2003 | |
| WO | WO 2006/026883 | | | 3/2006 | |
| WO | WO 2008/089373 | | | 7/2008 | |
| WO | WO 2009/046570 | | | 4/2009 | |
| WO | WO 2010/040241 | | | 4/2010 | |

* cited by examiner

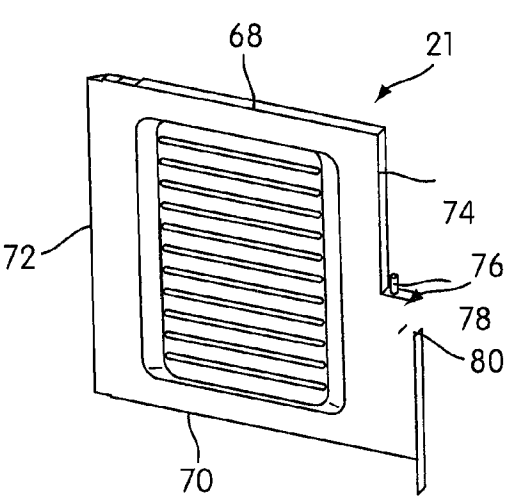
FIG. 8c3
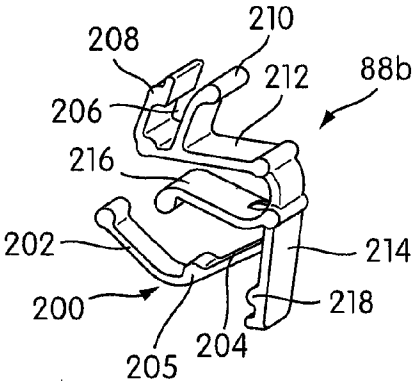
FIG. 8c6
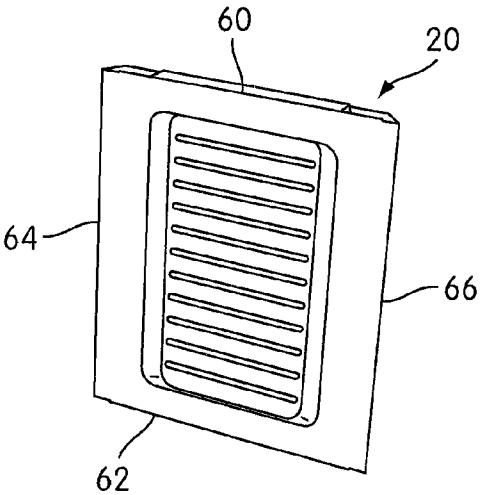
FIG. 8c2
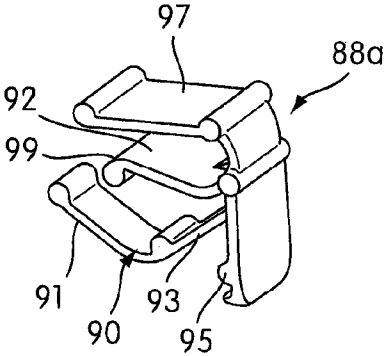
FIG. 8c5
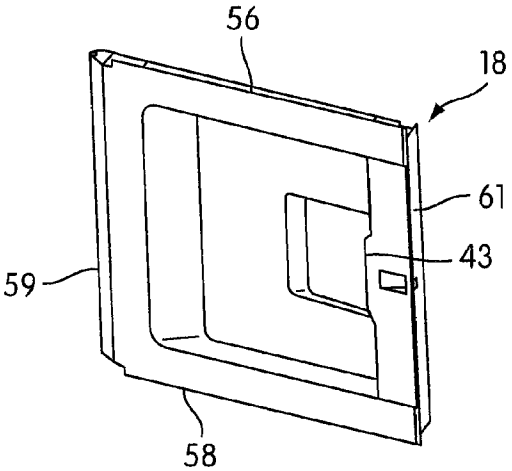
FIG. 8c1
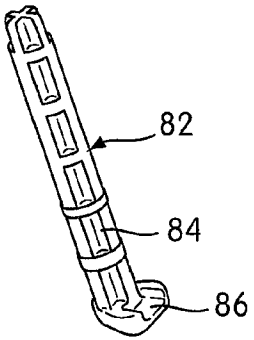
FIG. 8c4

SHELVING SYSTEM

BACKGROUND OF THE INVENTION

Field of the Invention

The present invention relates to a shelving system.

Shelving assemblies are used to store a variety of objects. However, such shelving assemblies typically do not have closure members or drawers that can be retrofitted to the assembled shelving system to form cabinet structures or other configurations. There is a need in the art for an improved storage system.

SUMMARY

One aspect of the invention provides a shelving system having a plurality of tubular frame members and a plurality of shelves, the shelves having frame receiving regions arranged to receive ends of the tubular frame members. The plurality of shelves and plurality of tubular frame members are connectable by insertion of the tubular frame members into the frame receiving regions to form an openly configured, assembled shelving unit in which the shelves are connected to one another in vertically spaced relationship by the frame members. The shelving system also has at least one closure member. The assembled shelving unit and the at least one closure member both have an integrally molded connector structure. The integrally molded connector structures enable the at least one closure member to be connected to the assembled shelving unit after the shelving unit has been assembled.

Another aspect provides a shelving system having a plurality of tubular frame members and a plurality of shelves. The shelves have frame receiving regions arranged to receive ends of the tubular frame members. The plurality of shelves and plurality of tubular frame members are connectable by insertion of the tubular frame members into the frame receiving regions to form an openly configured, assembled shelving unit in which the shelves are connected to one another in vertically spaced relationship by the frame members. The shelving system also includes a container constructed and arranged to be supported by the assembled shelving unit. The container includes a base and a plurality of side walls. At least one of the plurality of side walls is pivotally connected to the base and at least one of the plurality of side walls is connectable to the base and/or other side walls via a snap-fit connection.

Another aspect provides a container having a base and a plurality of side walls. At least one of the plurality of side walls is pivotally connected to the base and at least one of the plurality of side walls is connectable to the base and/or other side walls via a snap-fit connection.

Another aspect provides a shelving system having a plurality of shelves=and a drawer constructed and arranged to be operatively connected to one of the plurality of shelves. The shelving system also includes a drawer slide having a first slide member and a second slide member. The first slide member is constructed and arranged to be connected to the one of the plurality of shelves and the second slide member is constructed and arranged to be connected to the drawer so as to enable the drawer to be slideable relative to the one of the plurality of shelves.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

FIGS. 8*c*1-8*c*6 show components of a cabinet structure in accordance with an embodiment;

DETAILED DESCRIPTION OF THE INVENTION

Figure 1:
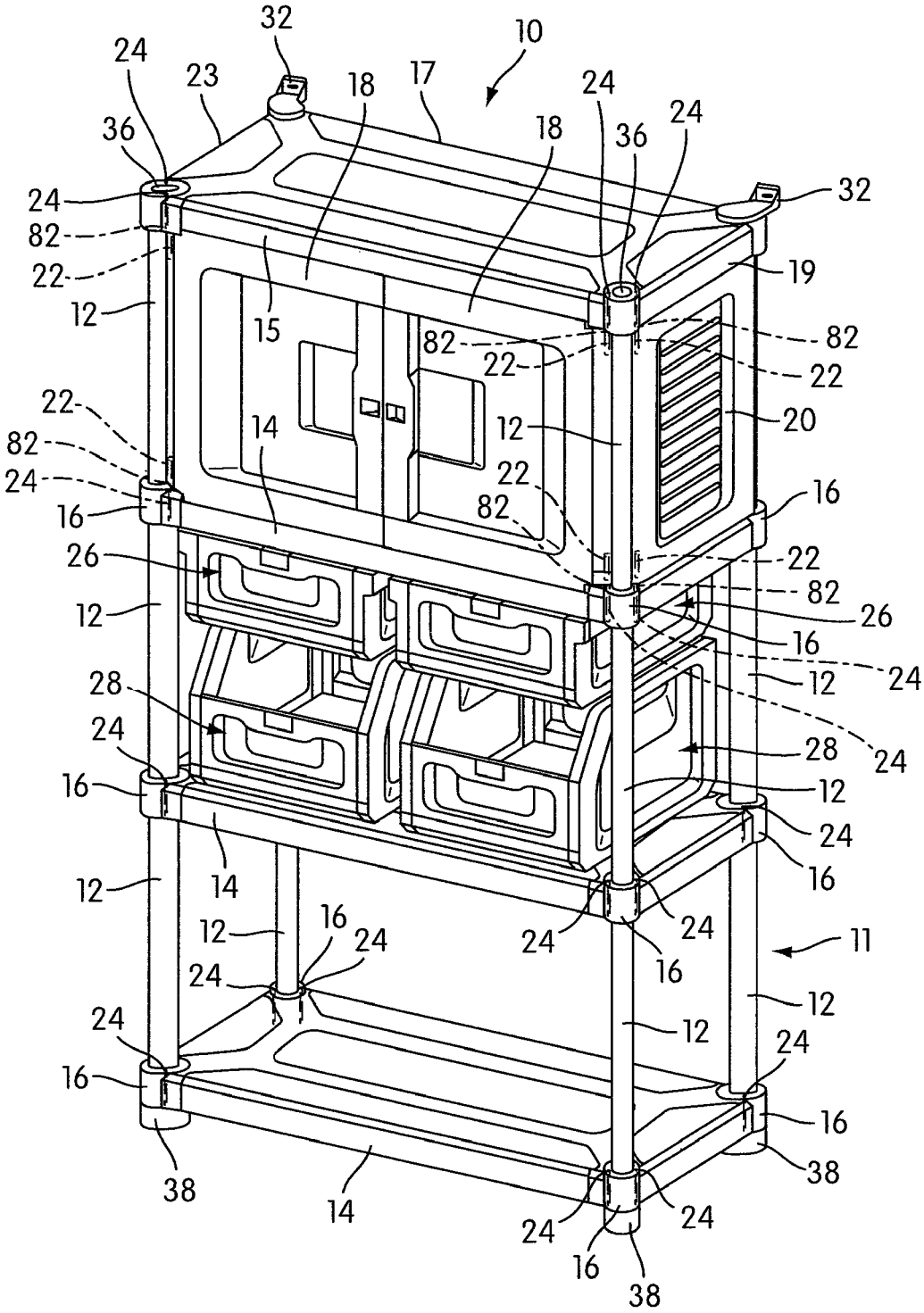
FIG. 1 is a front perspective view of a shelving system in accordance with an embodiment.

FIG. 1 shows a shelving system 10 having a plurality of tubular frame members 12 and a plurality of shelves 14. The shelves 14 have frame receiving regions 16 arranged to receive ends of the tubular frame members 12. The plurality of shelves 14 and plurality of tubular frame members 12 are connectable by insertion of the tubular frame members 12 into the frame receiving regions 16 to form an openly configured, assembled shelving unit 11 in which the shelves 14 are connected to one another in vertically spaced relationship by the frame members 12. The shelving system 10 also includes at least one closure member, which may take the form of doors 18 or walls 20, 21 (see also FIG. 2). The assembled shelving unit 11 and the at least one closure member both have an integrally molded connector structure 22, 24 (see FIG. 9*a*), wherein the integrally molded connector structures 22, 24 enable the at least one closure member to be connected to the assembled shelving unit 11 after the shelving unit 11 has been assembled. That is, after the assembled shelving unit 11 has been assembled, the at least one closure member may be retrofitted to the shelving unit 11 using the integrally molded connector structures 22, 24. In the embodiments described below, the tubular frame members 12, the shelves 14, and the closure members are made of molded plastic. Furthermore, in these embodiments, the connector structures 22, 24 are integrally molded into the shelving unit and the at least one closure member, respectively. However, it should be appreciated that these embodiments are not intended to be limiting, and in other embodiments, metal, wood, other materials, or a combination thereof may be used.

Containers may be supported on or added to the shelving unit 11 after the shelving unit 11 has been assembled, For example, in the embodiment shown in FIG. 1, the shelving system 10 includes drawers 26 that may be connected to the shelving unit 11 after the shelving unit 11 has been assembled. After the shelving unit 11 has been assembled, bins 28 may also be placed on the shelves 16 for additional storage. Accordingly, in some embodiments, after the shelving unit 11 has been assembled wherein the plurality of frame members 12 are connected to the shelves 14 such that the shelves 14 are arranged in vertically spaced relationship by the frame members 12, additional storage features, such as the drawers 26 or closure members, may be retrofitted to the shelving unit 11. This may enable the shelving system 10 to be configurable after assembly. Optional wall supports 32 may also be provided to support and/or retain the shelving system 10 against a wall. Accordingly, in some embodiments, the optional wall supports 32 enable the cabinet structures 30 to be provided without the rear walls 21. Instead, in such embodiments, the wall against which the shelving system 10 is retained may serve as the rear walls of the cabinet structures 30.

Figure 2:
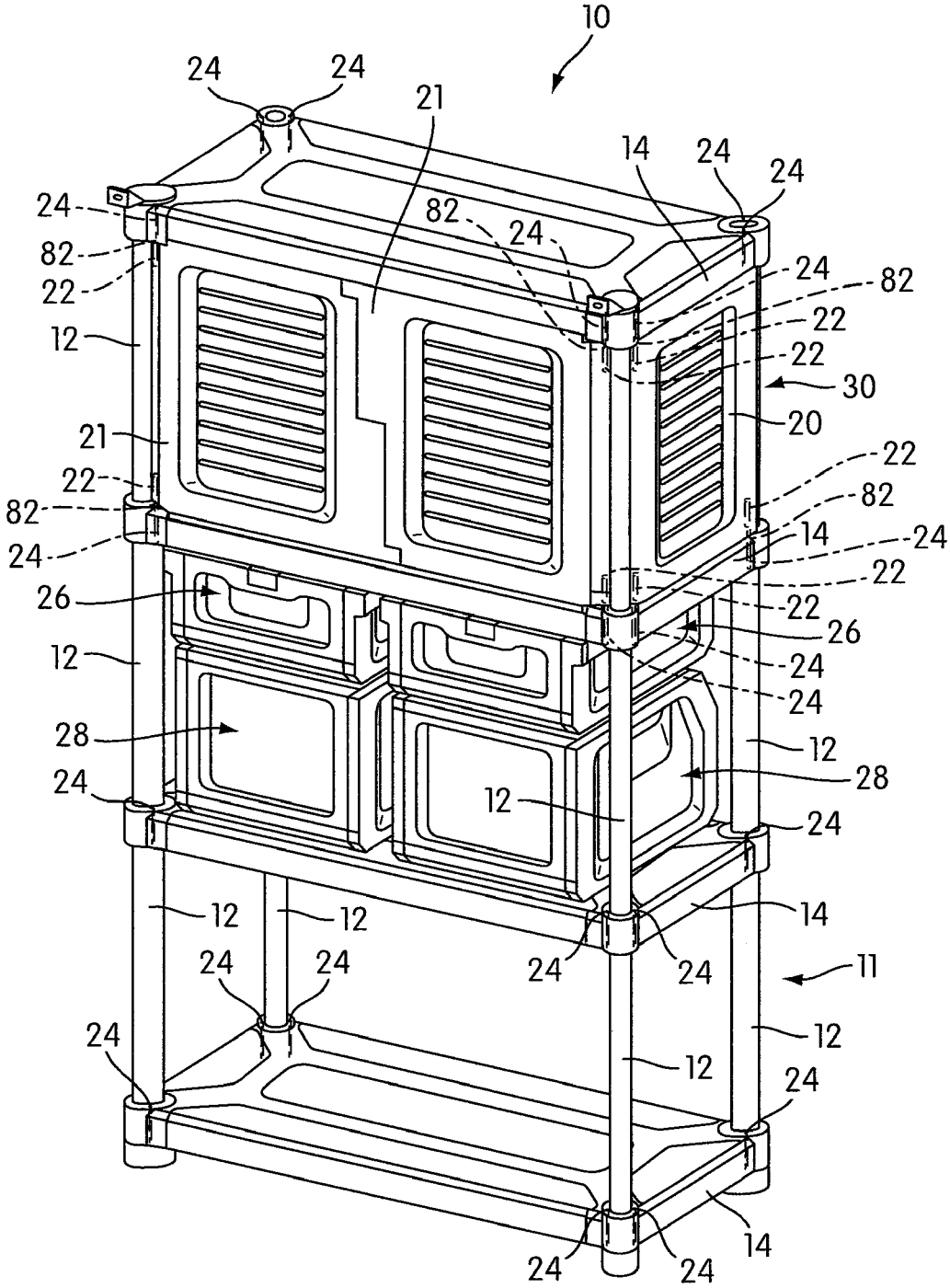
FIG. 2 is a rear perspective view of the lock in accordance with an embodiment.

FIG. 2 shows a rear perspective view of the embodiment of the shelving system 10 shown in FIG. 1. As shown in this Figure, the closure members, which take the form of doors 18 (obstructed from view in this Figure), side walls 20, and rear walls 21, form an enclosure. In this embodiment, the enclosure takes the form of a cabinet structure 30. An interior space 31 (see FIG. 3) may be provided in the cabinet structure 30. It should be appreciated that although only four shelves are shown in this embodiment to form three levels, additional or fewer shelves may be provided in other embodiments to form other number of levels. Furthermore, the placement or configuration of the side walls 20, rear walls 21, doors 18, drawers 26, and bins 28 may vary in other embodiments.

Figure 3:
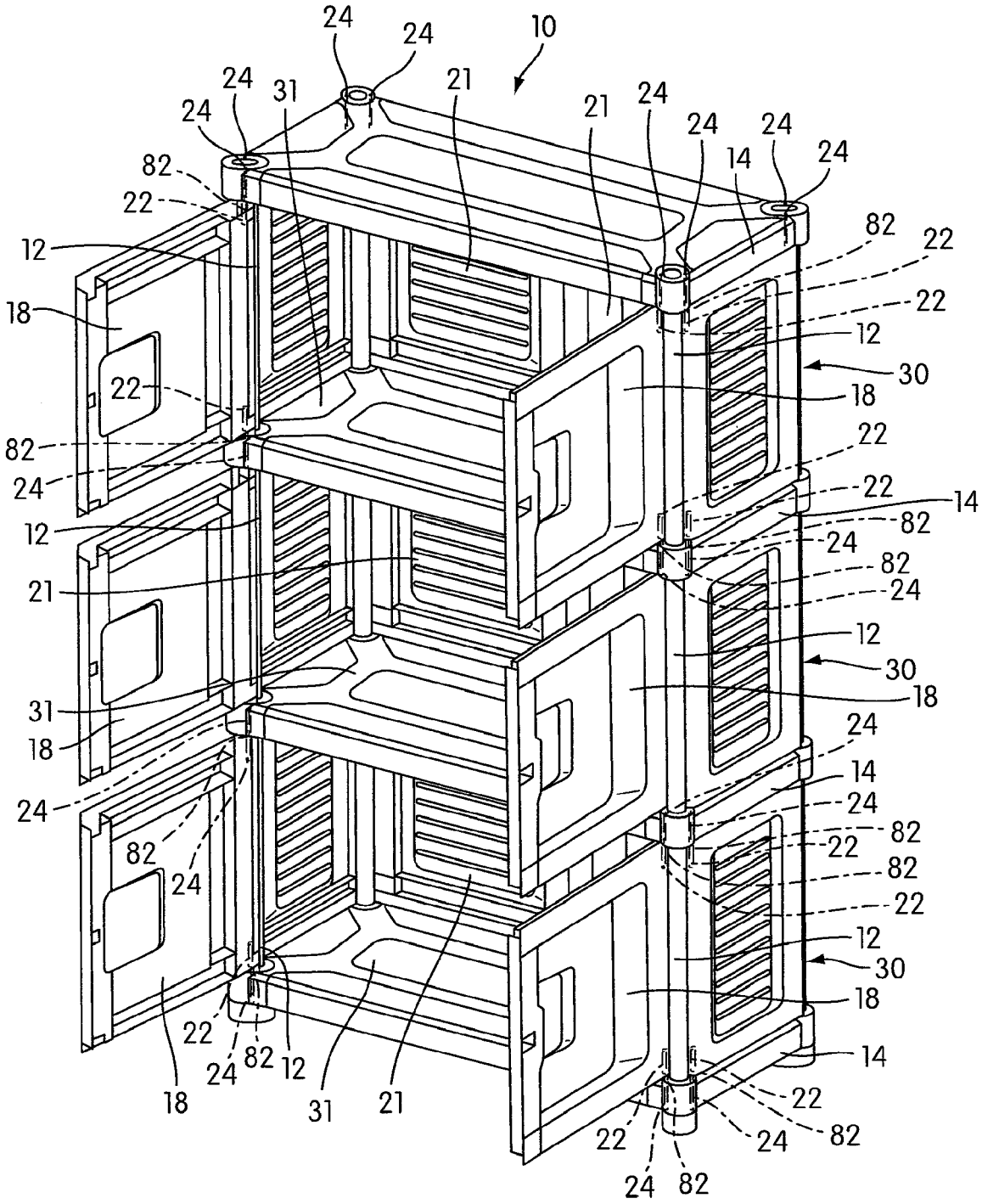
FIG. 3 is a front perspective view of a shelving system in accordance with another embodiment.
Figure 4:
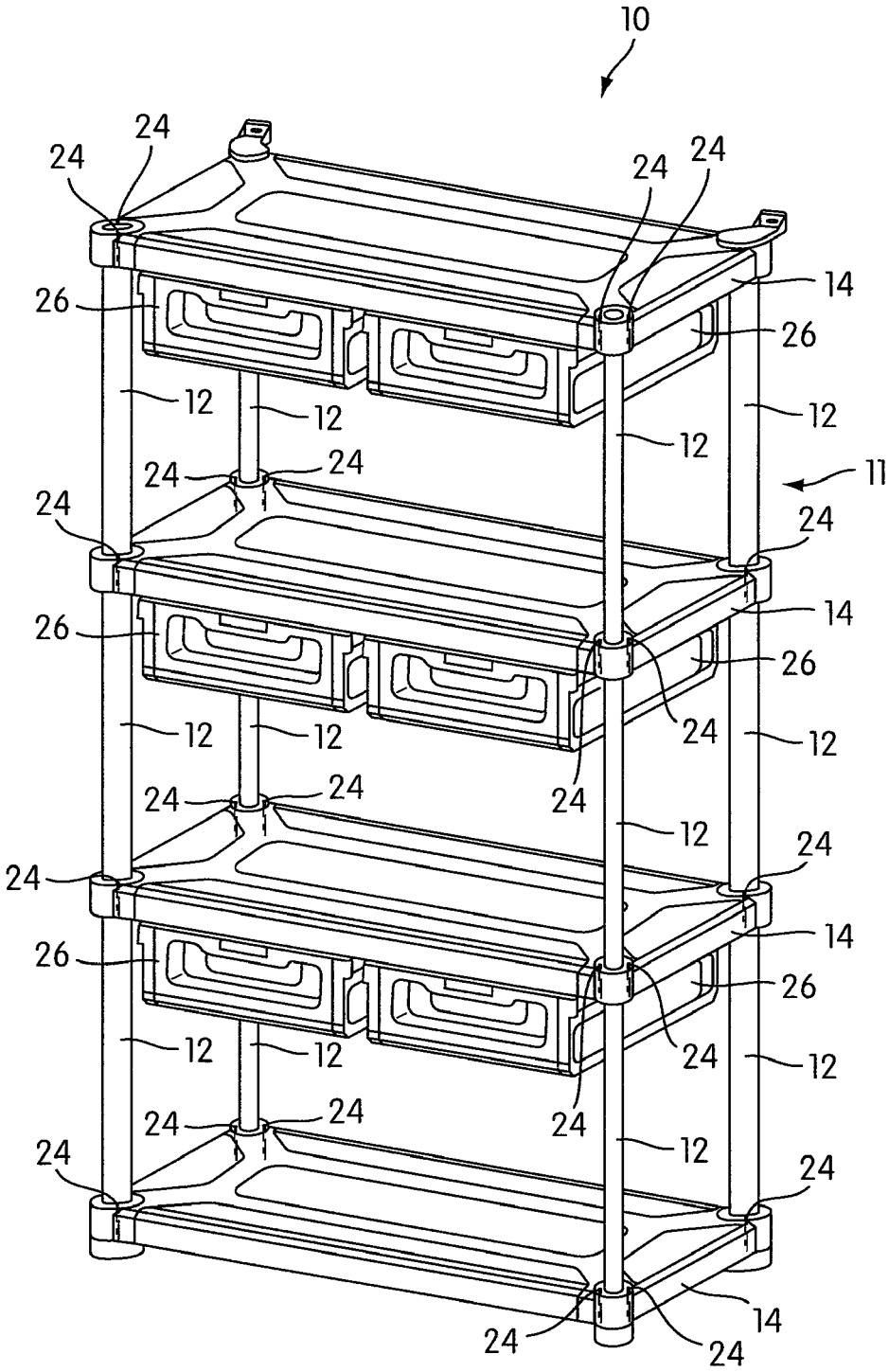
FIG. 4 is a front perspective view of a shelving system in accordance with yet another embodiment.

FIG. 3 shows another embodiment of the shelving system 10. In this embodiment, doors 18, side walls 20, and rear walls 21 may be retrofitted to the shelving system 10 to form three cabinet structures 30. Thus, in this embodiment, each level of the shelving system 10 includes a cabinet structure 30. FIG. 4 shows a front perspective view of another embodiment of the shelving system 10 having a plurality of drawers 26 retrofitted to the shelving unit 11 after the shelving unit 11 has been assembled. In this embodiment, each level of the shelving system 10 has two drawers 26 that hang from the shelves 14. The shelves 14 may be provided with ribs on an underside thereof to strengthen the shelves 14.

Figure 5:
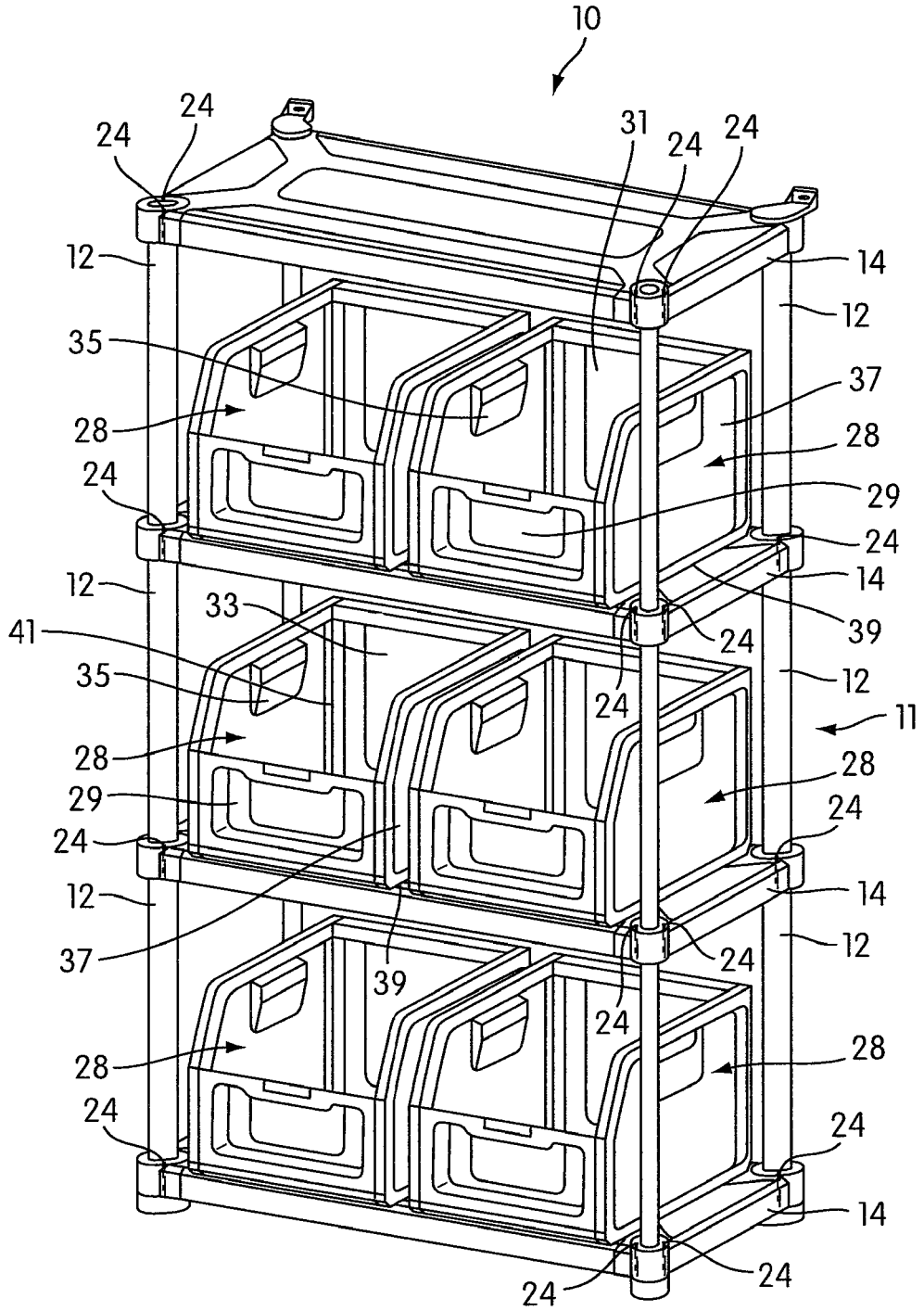
FIG. 5 is a front perspective view of a shelving system in accordance with yet another embodiment.

FIG. 5 shows a front perspective view of yet another embodiment of the shelving system 10. As mentioned above, containers may be supported on the shelving unit 11 after the shelving unit 11 has been assembled. In this embodiment, the shelving system 10 includes a plurality of containers that take the form of bins 28 that are supported on the shelves 14. In particular, each level of the shelving system 10 includes two bins 28 for additional storage. Thus, the shelving system 10 may be configured in a variety of ways after the shelving unit 11 has been assembled. The bins may have the same configurations as one another or may have different configurations. In one embodiment, the bins 28 have a front wall 29, a rear wall 33, a left wall 35, a right wall 37, and a base wall 39. The front wall 29 may be lower in height than the rear 33 to facilitate access to an interior space 41 of the bin 28.

Figure 6D:
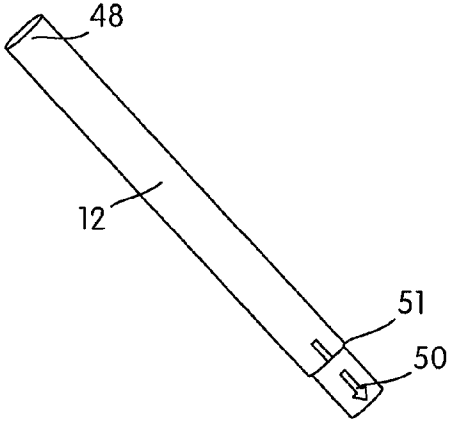
FIGS. 6*a*-6*e* show components of a shelving system in accordance with an embodiment.
Figure 6C:
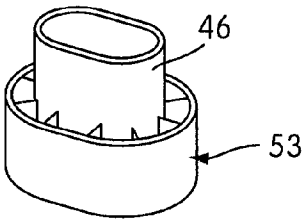
Figure 6B:
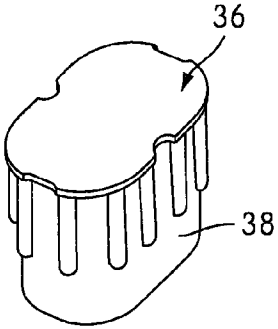
Figure 6A:
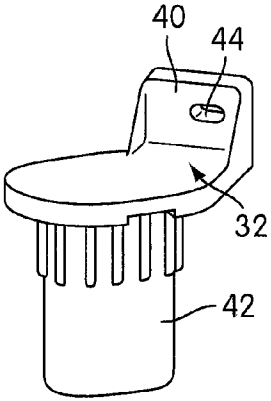
Figure 6E:
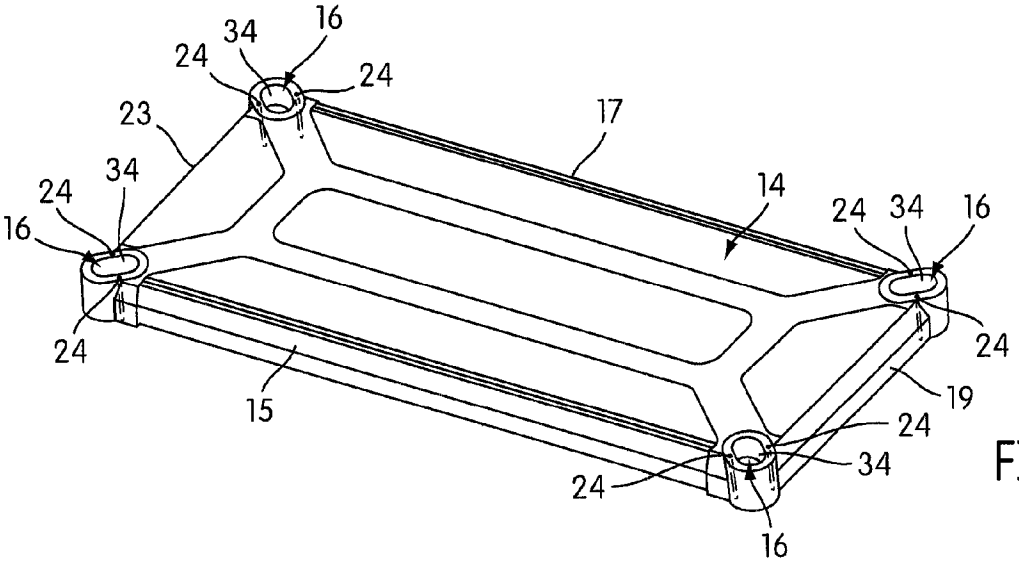

FIGS. 6*a*-6*e* show some components of the shelving system 10. As shown in FIG. 6*e*, the shelves 14 may include a front portion 15, a rear portion 17, side portions 19, 23, and the frame receiving regions 16. Each of the frame receiving regions 16 includes an opening 34. In this embodiment, the opening 34 is oval-shaped and is similar to the shape of the frame members 12. However, in other embodiments, it is contemplated that the opening 34 may have other shapes and the frame members 12 may also have other shapes. The openings 34 of the frame receiving regions 16 may be constructed and arranged to receive the wall support 32, an end of a frame member 12, a top cover 36, or a leg 53. As shown in FIG. 6*a*, the wall support 32 includes an upper portion 40 constructed and arranged to help support and/or retain the wall support 32 against a wall or other surface and a insertion portion 42 constructed and arranged to be inserted into the openings 34 of the shelves 14. An opening 44 is provided in the upper portion 40 of the wall support 32, the opening 44 being constructed and arranged to receive a screw, fastener, or other attachment device that can be used to attach the wall support 32 to a wall or other surface. As shown in FIG. 6*b*, the top cover 36 may include a insertion portion 38 constructed and arranged to be received in the openings 34 of the top most shelf 14 that are not already receiving the wall supports 32. That is, in one embodiment, such as the embodiment shown in FIG. 1, the top most shelf 14 is provided with two wall supports 32 and two top covers 36 that are received in openings 34 of the shelf 14.

Referring to FIG. 6*c*, the leg 53 includes an insertion portion 46 constructed and arranged to be received in the openings 34 of the shelf 14. The legs 53 may help support the shelving system 10 and provide more stability thereto when the shelving system 10 is placed on a surface or floor, as shown in FIG. 1. Referring to FIG. 6*d*, the frame member 12 includes an upper end 48 and a lower end 50. In one embodiment, the lower end 50 has a smaller circumference or perimeter than the rest of the frame member 12, and thus a ledge 51 is defined between the lower end 50 and the rest of the frame member 12. To connect the frame members 12 to the shelves 14, the upper and lower ends 48, 50 may be constructed and arranged to be received in the openings 34 of the frame receiving regions 16, which will be described in more detail later. Each of the frame members 12 of the shelving system 10 may have the same configuration.

Figure 7A:
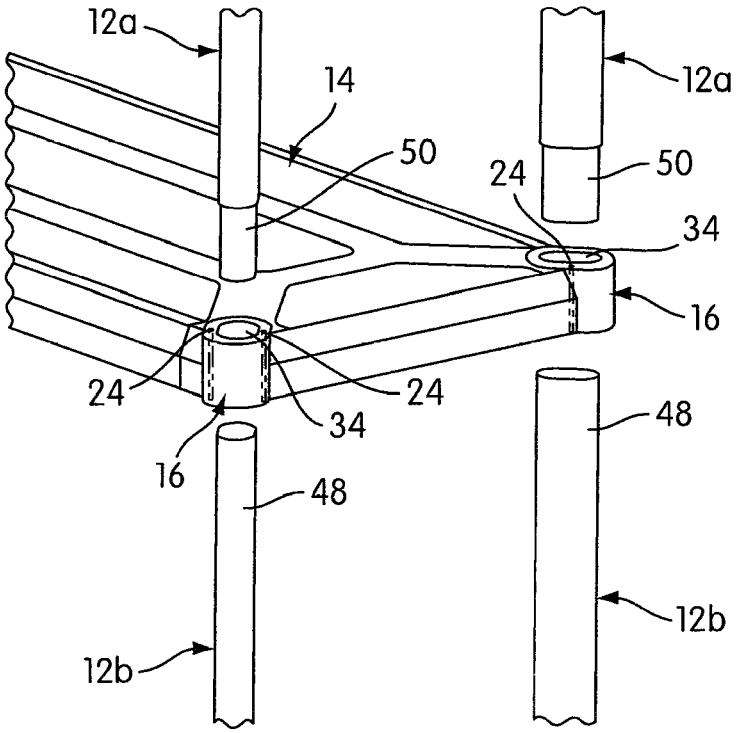
FIG. 7*a* is an exploded view of a portion of the shelving system in accordance with an embodiment.

FIG. 7*a* shows a detailed view of the frame members 12 before the frame members 12 are connected to the frame receiving regions 16 of the shelves 14. In this Figure, the lower end 50 of upper frame members 12*a* are aligned with the openings 34 of the frame receiving regions 16 of the shelf 14, and the upper end 34 of lower frame members 12*b* are also aligned with the openings 34 of the frame receiving regions 16 of the shelf 14. As mentioned above, each of the frame members 12 may have the same configuration.

Figure 7B:
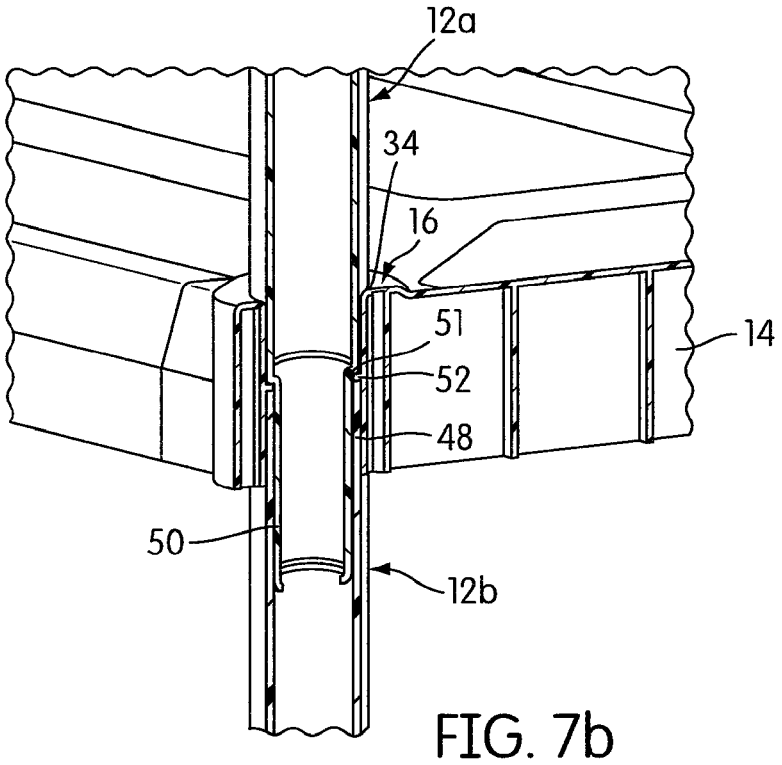
FIG. 7*b* is a detailed view of a portion of the assembled shelving system with certain parts removed to better reveal others.

The upper and lower frame members 12*a*, 12*b* may be connected to the frame receiving regions 16 of the shelves 14, as shown in FIG. 7*b*. In this embodiment, the opening 34 of the frame receiving region 16 is provided with an annular flange 52 in a middle portion thereof. When the upper and lower frame members 12*a*, 12*b* are received in the opening 34 of the frame receiving region 16, the lower end 50 of the upper frame member 12*a* is telescopically received in the upper end 48 of the lower frame member 12*b*. In this embodiment, the upper end 48 of the lower frame member 12*b* abuts against the flange 52. The ledge 51 defined between the lower end 50 of the upper frame member 12*a* and the rest of the upper frame member 12*a* may also abut against the flange 52. Accordingly, the flange 52 may help facilitate the connection between the upper and lower frame members 12*a*, 12*b* and the frame receiving region 16. The flange 51 may also serve as a stop member or indicator as to when the upper and lower ends 48, 50 have been inserted sufficiently into the openings 34 of the frame receiving region 16. It should be appreciated that in other embodiments, the configuration of the upper end 48 and the lower end 50 may be interchanged. For example, in other embodiments, the upper and lower ends 48, 50 may be constructed and arranged such that the upper end 48 of the lower frame member 12*b* is telescopically received in the lower end 50 of the upper frame member 12*a*.

Figure 8A:
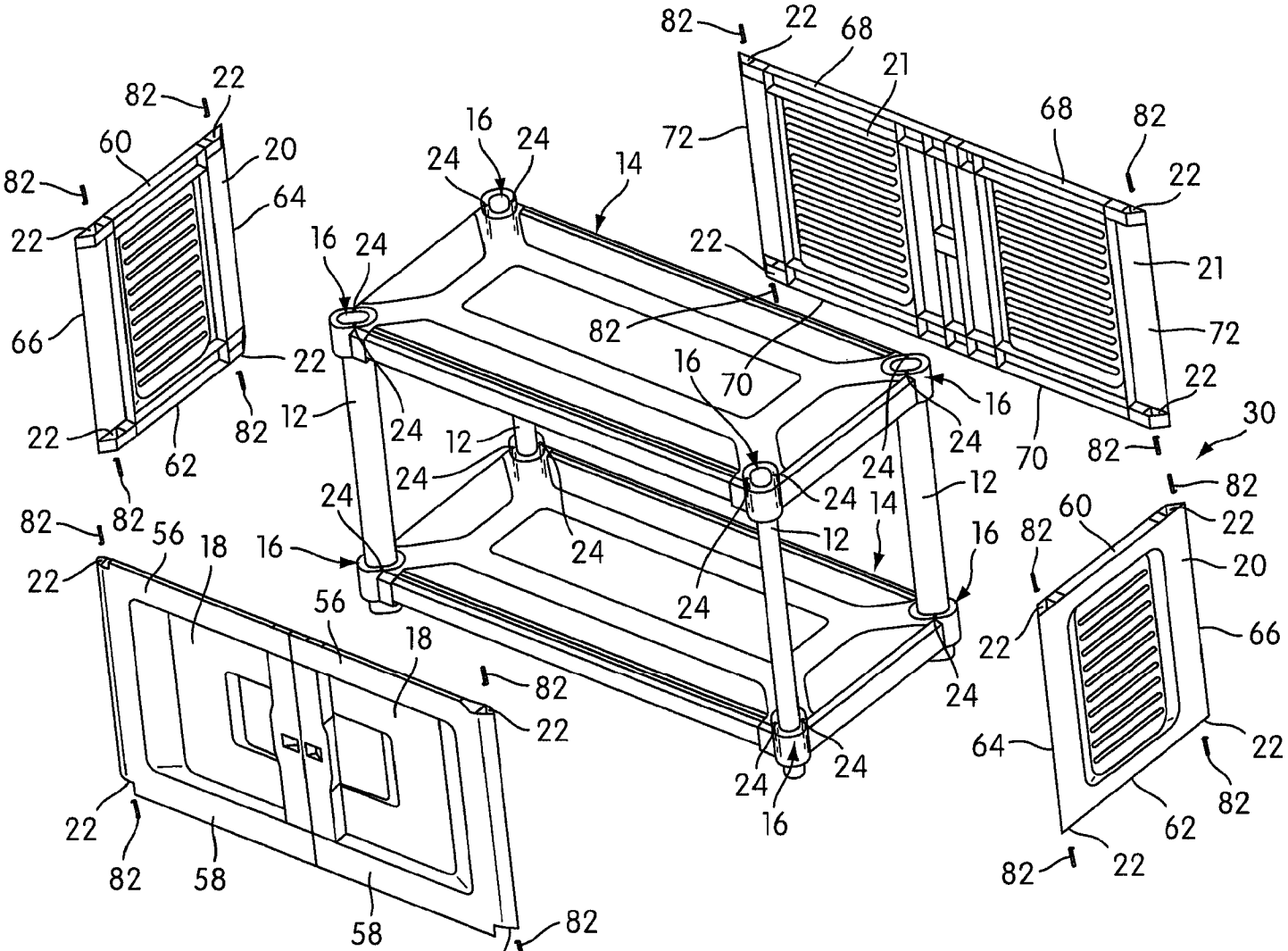
FIG. 8*a* is an exploded view of components of a cabinet structure of the shelving system in accordance with an embodiment.
Figure 8B:
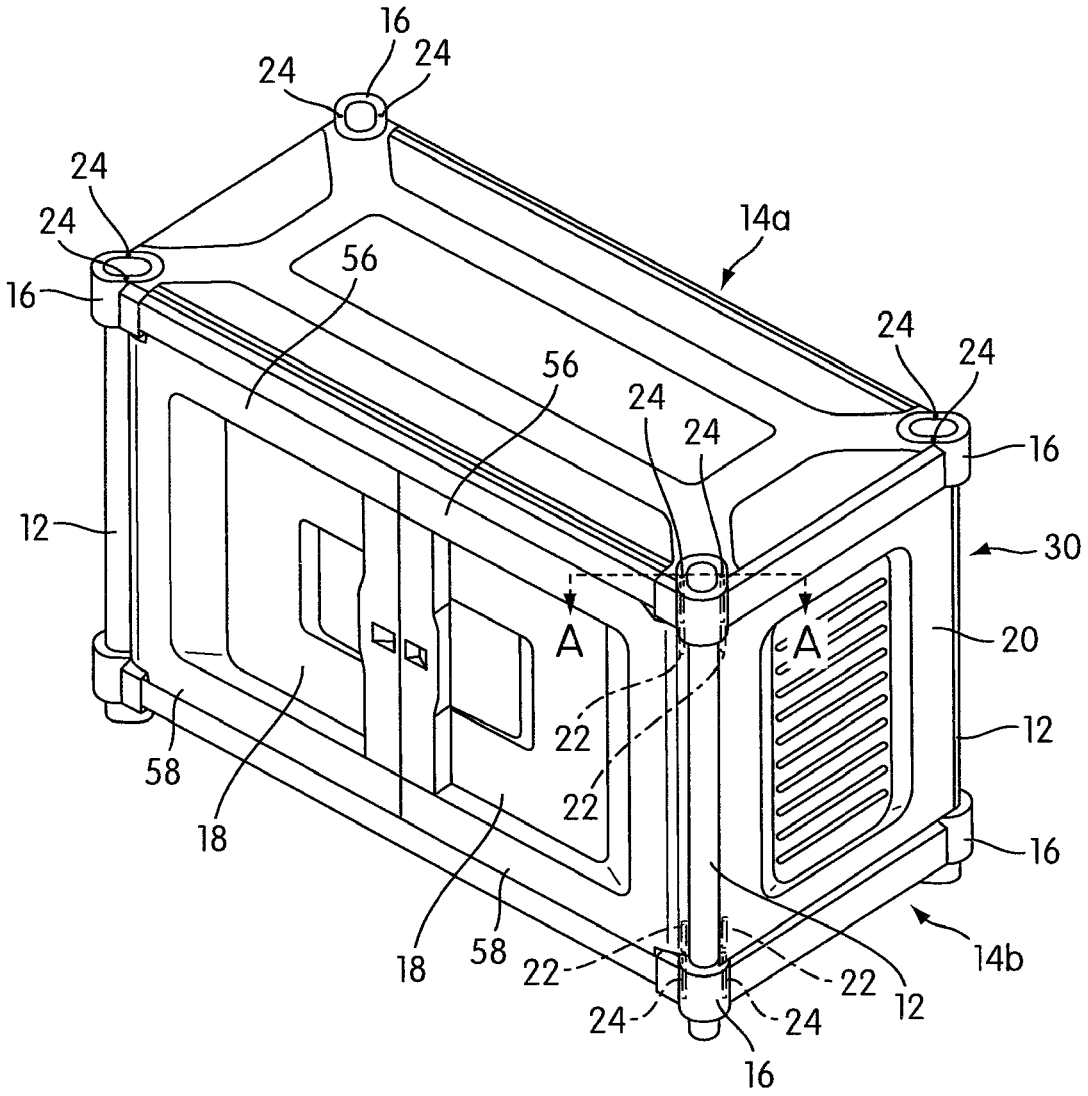
FIG. 8*b* is a perspective view of an assembled cabinet structure of the shelving system in accordance with an embodiment.

After the shelving system 10 has been assembled wherein the frame members 12*a* are connected to the shelves 14, the doors 18, side walls 20, and rear walls 21 may be retrofitted to the shelving system 10 to form the cabinet structure 30. FIG. 8*a* shows an exploded view of the components of the cabinet structure 30. In the embodiment shown in FIG. 8*a*, the cabinet structure 30 is formed using two doors 18, two side walls 20, and two rear walls 21. It should be appreciated that although there are two rear walls 21 shown in this embodiments, the rear walls 21 may be optional in other embodiments and some embodiments might have no rear walls. The two doors 18 may have the same configuration as each other, the two side walls 20 may have the same configuration as each other, and the two rear walls 21 may have the same configuration as each other. FIG. 8*b* shows the assembled cabinet structure 30 using the components shown in FIG. 8*a*. FIGS. 8*c*1-8*c*6 show components of the cabinet structure 30 that may be retrofitted to the shelving system 10.

As shown in FIG. 8*c*1, the door 18 includes an upper portion 56, a lower portion 58, a first side portion 59, and a second side portion 61. A handle 43 may be provided on the door 18 to facilitate the opening and closing of the door 18. The first side portion 59 may be pivotally connected to the shelving system 10, which will be described in more detail later. A recess (obstructed from view in FIG. 8*c*1) may be provided under the handle 43 and near the second side portion 61 to facilitate a user in opening or closing the door 18 after the door 18 has been connected to the assembled shelving system 10. As shown in FIG. 8*c*2, the side wall 20 includes an upper portion 60, a lower portion 62, a left portion 64, and a right portion 66. As shown in FIG. 8*c*3, the rear wall 21 includes an upper portion 68, a lower portion 70, a left portion 72, and a right portion 74. A ledge 76 may be formed in the right portion 74, and a pin 78 and an opening 80 may be formed on or in the ledge 76. The ledge 76 may be constructed and arranged such that when the rear walls 21 are assembled together with one turned upside down, as shown in FIG. 2, the pin 78 of a first rear wall 21 may be received in the opening 80 of a second rear wall 21, and the pin 78 of the second rear wall 21 may be received in the opening 80 of the first rear wall 21. In some embodiments, pins 82 may be used to connect the integrally molded connector structure 22 of the at least one molded plastic closure to the integrally molded connector structure 24 of the shelving system 10. As shown in FIG. 8*c*4, the pin 82 may include a lower portion 84 and an upper portion 86. The upper portion 86 may take the form of a head that prevents further insertion of the pin 82 into the connector structures 22, 24.

In some embodiments, a door stopper or retainer member 88*a* may also be provided. As shown in FIG. 8*c*5, the door stopper 88*a* may be constructed and arranged to retain the door 18 in a closed or open position. That is, the door stopper 88*a* may include a biasing member, taking the form of a leaf spring 90 in this embodiment, that helps retain the door 18 in the open or closed position, which will be described in more detail later. The leaf spring 90 includes an inclined first portion 91 and an inclined second portion 93 that form the V-shaped leaf spring 90. Furthermore, the door stopper 88*a* may include a shelf receiving area 92 constructed and arranged to receive a portion of the shelf 14. An extension portion 95 is constructed and arranged to extend from an upper portion 97. In this embodiment, the upper portion 97 and the extension portion 95 are in a substantially perpendicular relationship. The shelf receiving area 92 may be defined between the upper portion 97 and an intermediate portion 99. At least portions of the door stopper 88*a*, including the upper portion 97 and the intermediate portion 99, may be made of resilient materials. Accordingly, the upper portion 97 and the intermediate portion 99 may be constructed and arranged to function as a clamp that may clamp a portion of the shelf 14 therebetween in the shelf receiving area 92, which will be described in more detail below.

FIG. 8*c*6 shows a second embodiment of a door stopper 88*b*. The door stopper 88*b*, like the door stopper 88*a* described above, may be constructed and arranged to retain the door 18 in a closed or open position. The door stopper 88*b* may include a biasing member, taking the form of a leaf spring 200 in this embodiment, that helps retain the door 18 in the open or closed position. The leaf spring 200 includes an inclined first portion 202 and an inclined second portion 204 that form the V-shaped leaf spring 200. The first portion 202 and the second portion 204 may meet at a junction 205. Furthermore, the door stopper 88*b* may include a door receiving area 206 constructed and arranged to receive a portion of the shelf 14. The door receiving area 206 may be defined between a first extension 208 and a second extension 210, the first and second extensions 208, 210 being constructed and arranged to extend from a horizontal portion 212. A vertical extension portion 214 may extend generally perpendicularly to the horizontal portion 212. The vertical extension portion 214 may also include a ridge 218 provided thereon, the ridge 218 being constructed and arranged to contact against a portion of the shelf 14 when the door 18 is in the closed position. An intermediate portion 216 may be configured to extend from the vertical extension portion 214 between the horizontal portion 212 and the leaf spring 200. At least portions of the door stopper 88*b*, including the first and second extensions 208, 210 and the leaf spring 200, may be made of resilient materials. Accordingly, the first extension 208 and the second extension 210 may be constructed and arranged to function as a clamp that may clamp a portion of the door 18 therebetween, which will be described in more detail later.

Figure 9A:
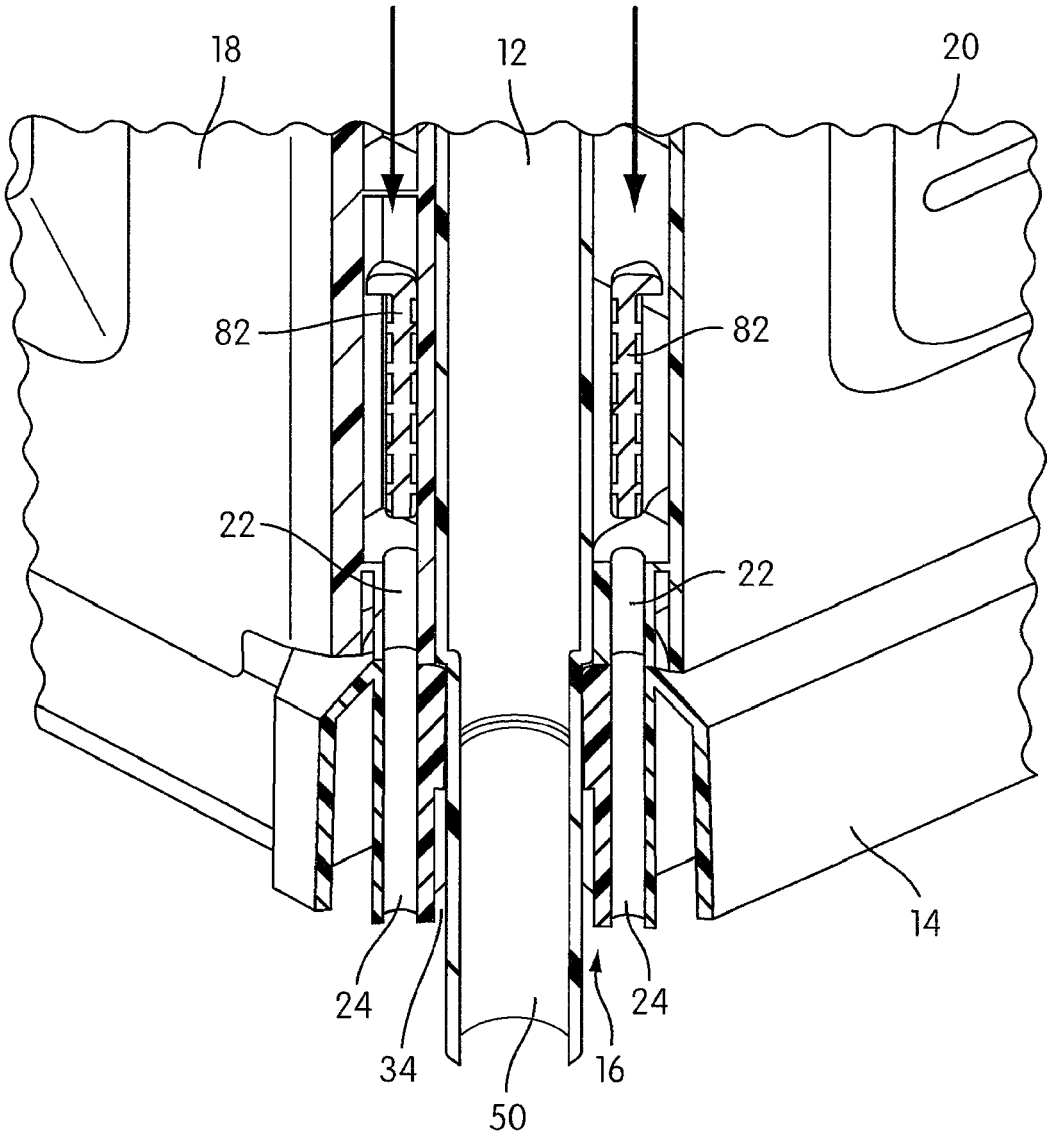
FIG. 9*a* shows the assembly of a portion of the cabinet structure of the shelving system with certain parts of the shelving system removed to better reveal others.
Figure 9B:
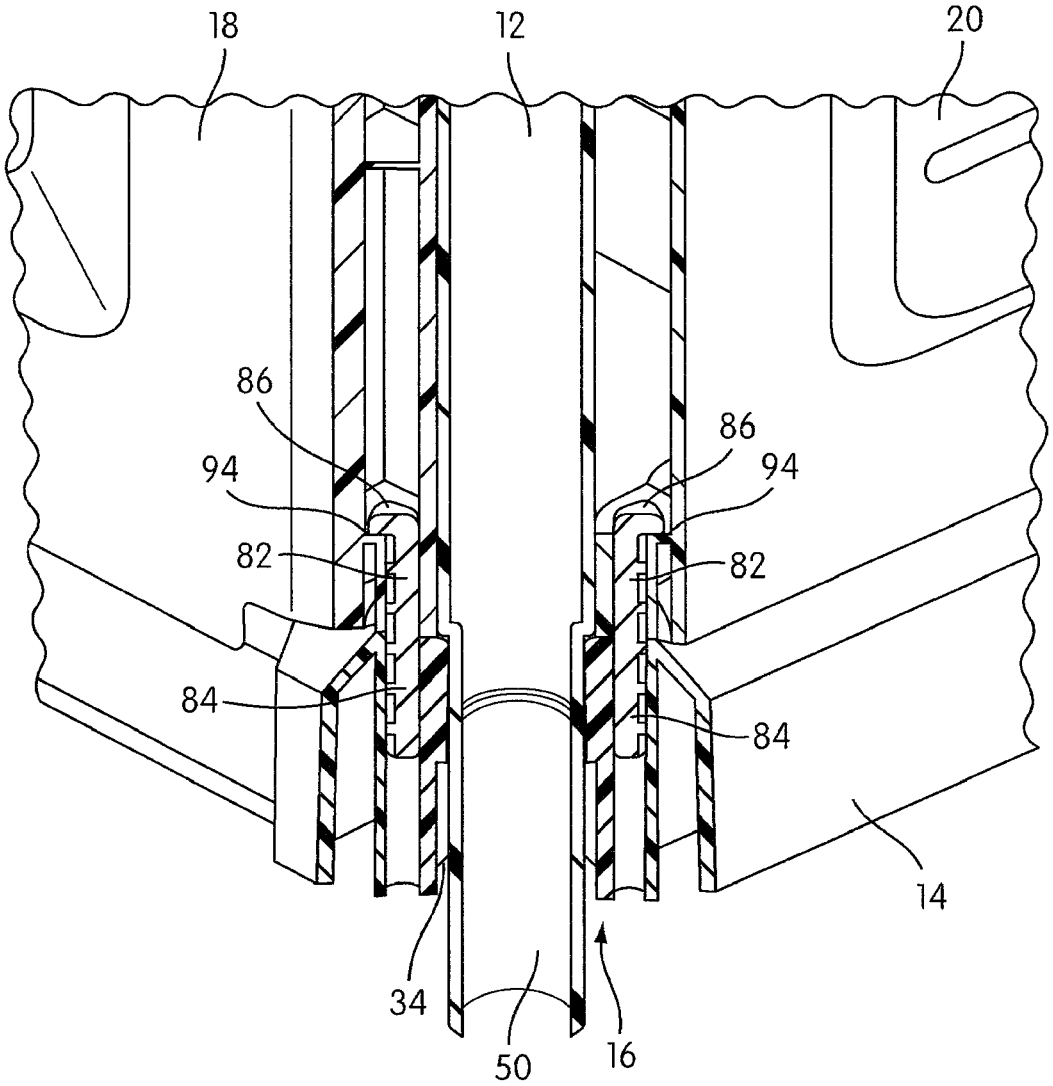
FIG. 9*b* is a detailed view of a portion of the assembled cabinet structure of the shelving system with certain parts removed to better reveal others.
Figure 10:
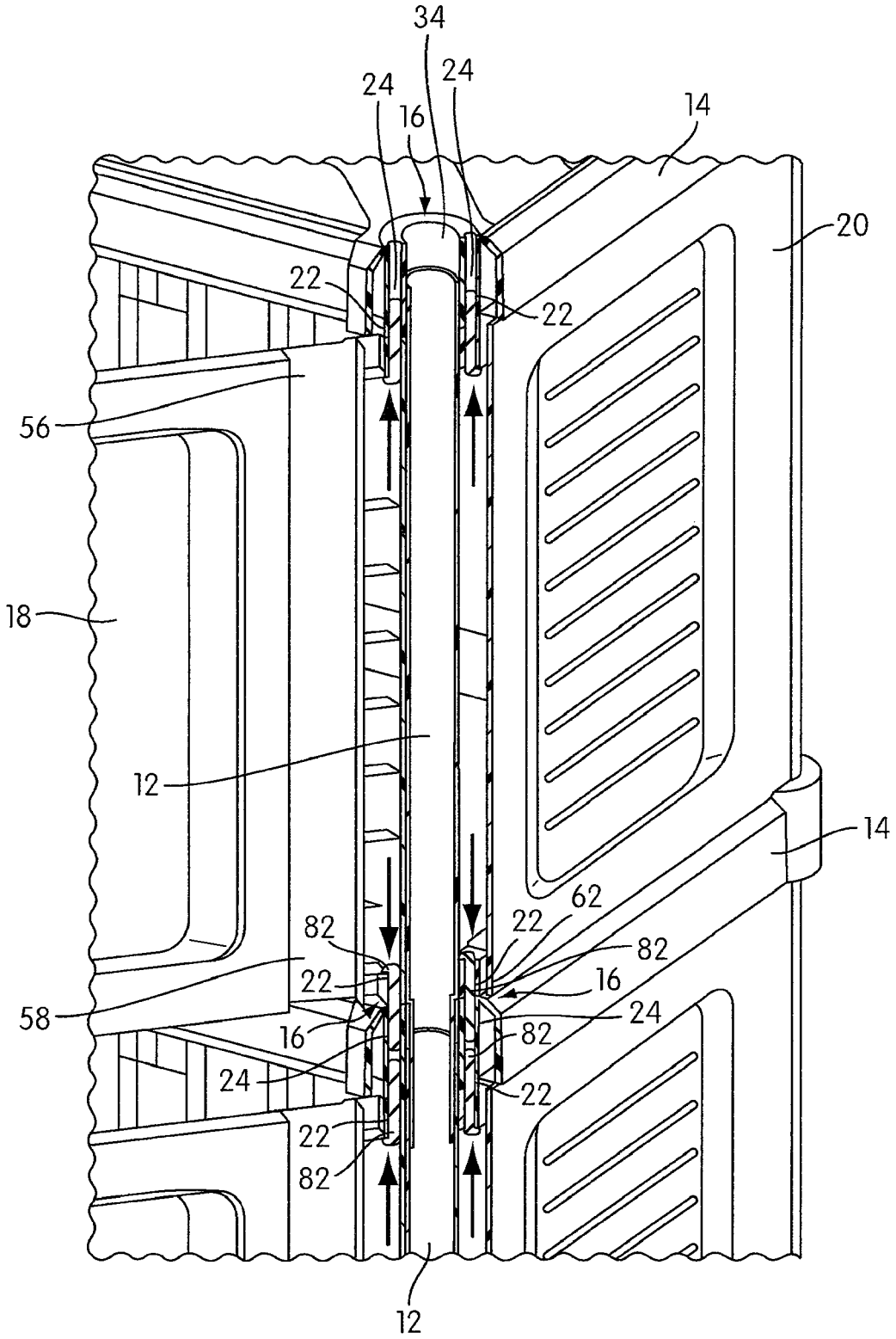
FIG. 10 is a detailed view of a portion of the assembled cabinet structure of the shelving system with certain parts removed to better reveal others.

FIG. 9*a*-9*b* illustrate the connection of the closure members (e.g., the doors 18, side walls 20, and rear walls 21) to the assembled shelving system 10 in accordance with an embodiment. In the embodiment shown in FIG. 9*a*, the closure members, which are the door 18 and the side wall 20 shown in this Figure, are provided with the integrally molded connector structures 22, which take the form of recesses in this embodiment. The other door 18, the other side wall 20, and the rear walls 21 may also be provided with integrally molded connector structure 22 having a similar configuration as the connector structure 22 shown in this Figure. In addition, in some embodiments, the doors 18 may be provided with two connector structures 22. For example, as shown in FIG. 10, the door 18 may be provided with a connector structure 22 near the upper end 56 thereof and a connector structure 22 near the lower end 58 thereof. The connector structure 22 may be used to connect the door 18 to the shelving unit 11, and may also enable the door 18 to pivot relative to the shelving unit 11 between an open position (see FIG. 3) wherein access to the interior space 31 of the cabinet structure 30 is permitted and a closed position (see FIG. 1) wherein access to the interior space 31 of the cabinet structure 30 is prevented. Furthermore, the side wall 20 may be provided with four connector structures 22, one at each corner thereof. For example, the integrally molded connector structures 22 may be provided at or near the intersections between the upper portion 60, lower portion 62, left portion 64, and right portion 66 of the side wall 20. Thus, in this embodiment, the four molded connector structures 22 of the side walls 20 enable the side walls 20 to be stably connected to the shelving unit 11. The rear walls 21 may be provided with integrally molded connector structures 22 near the left portion 72. For example, as shown in FIG. 8*a*, the connector structures 22 are provided at or near the intersection of the left portion 72 and the upper portion 68 and at or near the intersection of the lower portion 70 and the left portion 72. Although the connector structures 22 take the form of recesses in this embodiment, it is contemplated that the connector structures 22 may take other forms in other embodiments, such as just for example, tabs, pins, or snap fit connections. It should also be appreciated that the connector structures 22 may be separate pieces attached to the closure members in other embodiments.

As shown in the embodiment of FIG. 9*a*, the shelves 14 are also provided with the integrally molded connector structures 24. It should be appreciated, however, that in other embodiments, the integrally molded connector structures 24 may be provided on the frame members 12. To connect the shelves 14 and the closure members, the connector structures 22 of the closure members (for example, the door 18 and the side wall 20 shown in FIG. 9*a*) should be aligned with the connector structure 24 of the shelves. The other closure members may be connected to the shelves 14 using the pins 82 in a similar manner. The pins 82 may be inserted into the connector structures 22, 24 to connect them together. As shown in FIG. 9*b*, the connector structure 22 of the closure members (for example, the door 18 and the side wall 20 shown in this Figure), may be provided with a ledge 94 that is constructed and arranged to abut against the top portion 86 of the pins 82 when the pins 82 are fully inserted into the connector members 22, 24 of the closure members and the shelving system 10, respectively. In embodiments where two consecutive levels are provided with closure members to form cabinet structures 30, each connector structure 24 of the shelving system 10 may be constructed and arranged to receive two pins 82, as shown in FIG. 10. In such embodiments, the connector structures 24 of the shelving system 10 may be provided at or near the frame receiving regions 16. Thus, in some embodiments, two connector structures 24 may be integrally molded into the shelves 14 adjacent or near/at the frame receiving regions 16. Each of the connector structures 24 may be constructed and arranged to receive two pins 82, one upper pin and one lower pin. Accordingly, the closure members may be connected to the shelving system 14 using the connector structures 22, 24 and the pins 82 to form the cabinet structures 30. It should be appreciated that in some embodiments, the cabinet structures 30 may be formed without doors 18. Alternatively, it is contemplated that in some embodiments, the two doors 18 may be replaced by one wider door 18 that prevents or permits access to the interior space 31 of the cabinet structures 30.

Figure 11A:
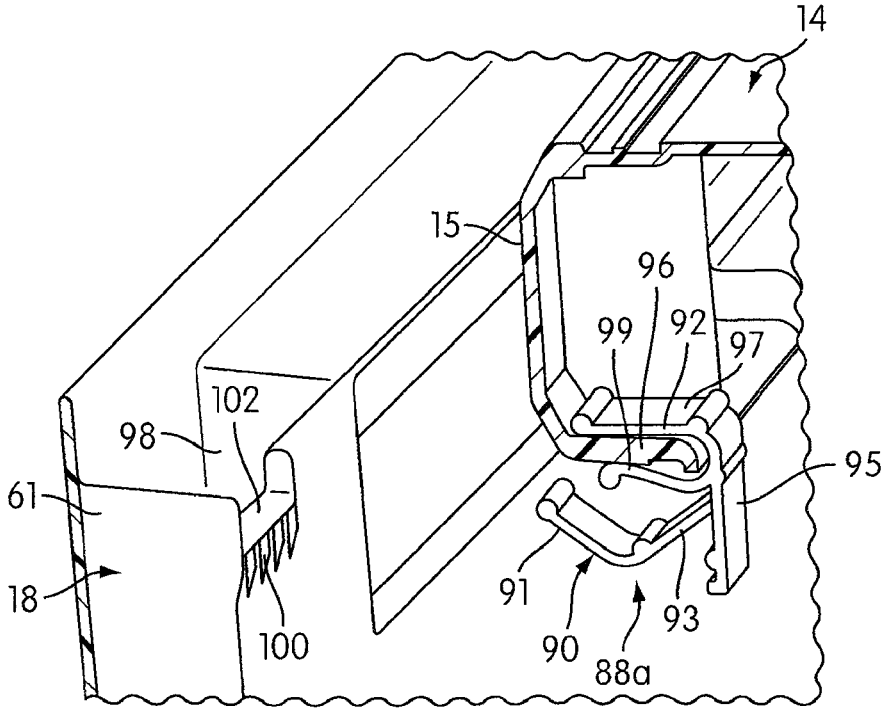
FIGS. 11*a*-11*b* shows a portion of the cabinet structure of the shelving system with certain parts removed to better reveal others.
Figure 11B:
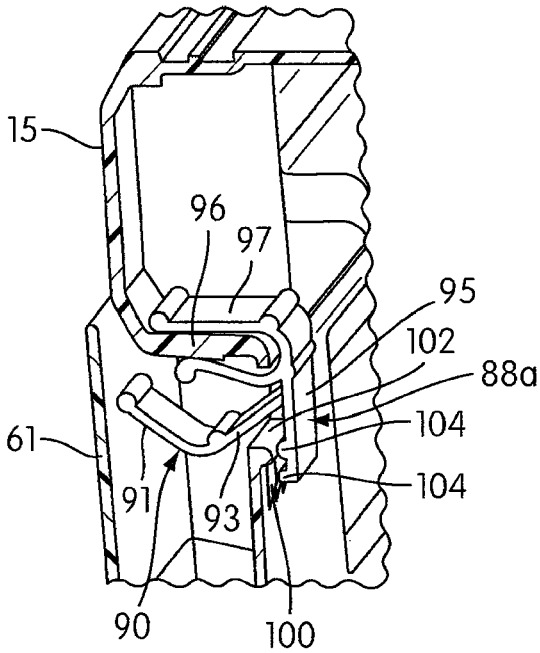
Figure 11C:
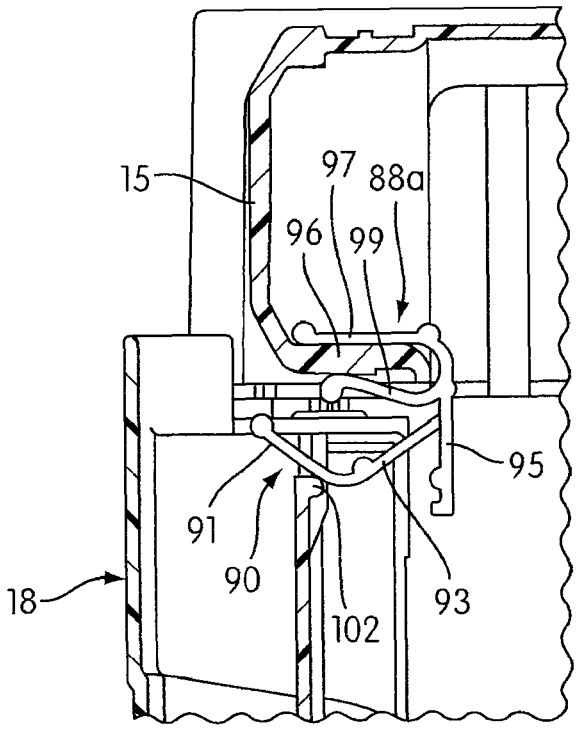
FIGS. 11*c*-11*d* are side cross sectional views of a portion of the cabinet structure with a door in the open position and a closed position, respectively, in accordance with an embodiment.
Figure 11D:
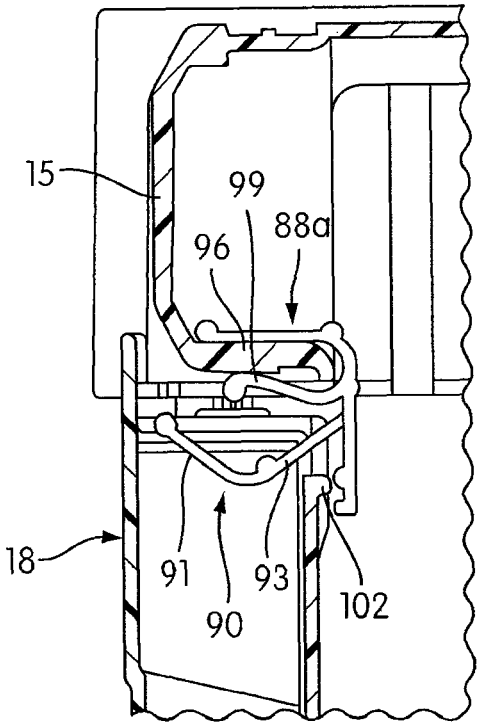

FIG. 11*a* shows an embodiment with the door 18 in the open position and the door stopper 88*a* attached to a front ledge portion 96 of the shelf 14. As shown in this Figure, the front ledge portion 96 of the shelf 14 is folded inwards and is received in the shelf receiving area 92 of the door stopper 88*a*. Thus, the upper portion 97 and the intermediate portion 99 of the door stopper 88*a* may function as a clamp that clamps the folded portion of the front ledge portion 96 of the shelf 14 therebetween in the shelf receiving area 92. The door stopper 88*a* is disposed such that the upper portion 97 of the door stopper 88*a* abuts against the portion of the front ledge portion 96 that is folded inward and the extension portion 95 extends substantially perpendicularly downwards from the upper portion 97. In this embodiment, a recess 98 is formed near the second side portion 61 of the door 18. Ridges 100 may optionally be provided on the door 18 below the recess 98. A ledge 102 may be formed between the recess 98 and the ridges 100. FIG. 11*b* shows the door 18 in the closed position wherein the ledge 100 is positioned closer to the second portion 93 than the first portion 91 of the door stopper 88*a*. The extension portion 95 of the door stopper 88*a* may abut against a portion of the door 18. In this embodiment, ridges 104 may optionally be provided on the extension portion 95 that abuts against a portion of the door 18. FIGS. 11*c*-11*d* show side views of the door stopper 88*a* and the door 18 in the closed position and the open position, respectively, with certain parts removed to better reveal others. The operation of closing/opening the door 18 and the function of the door stopper 88*a* with respect to the embodiment shown in FIGS. 11*c*-11*d* will be described in more detail later.

Figure 12A:
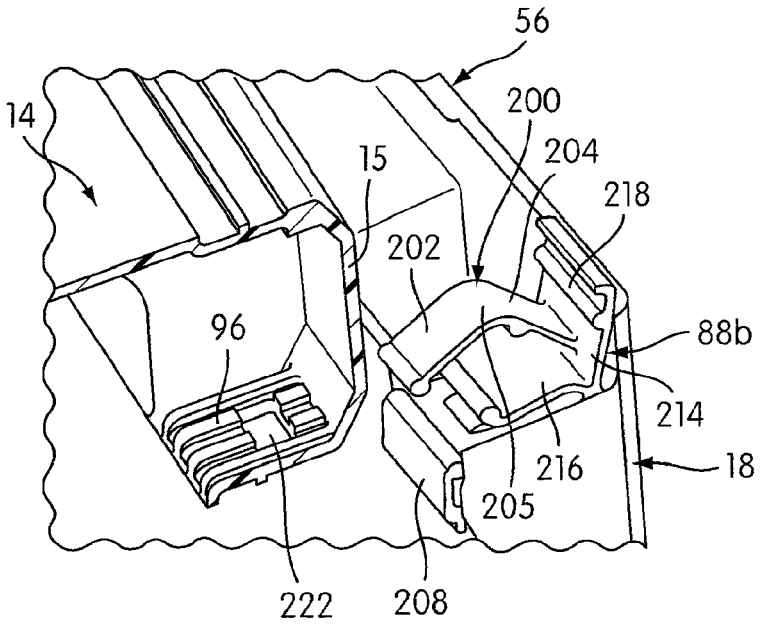
FIG. 12*a* shows a portion of the cabinet structure of the shelving system with certain parts removed to better reveal others.
Figure 12B:
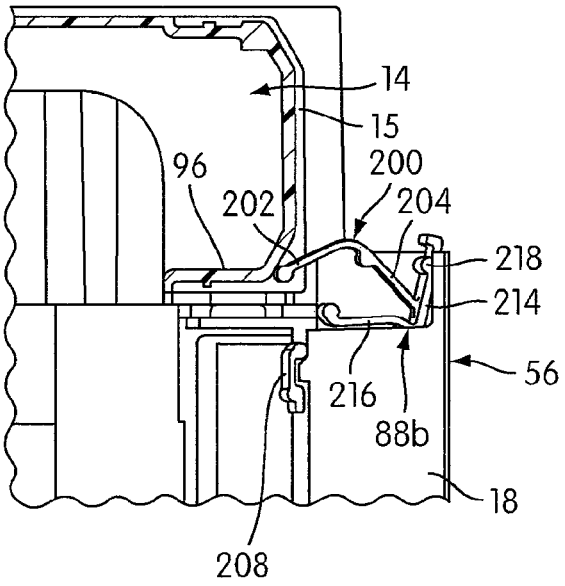
FIG. 12*b* is a side cross sectional view of a portion of the cabinet structure with the door in the open position in accordance with an embodiment.

FIG. 12*a* shows an embodiment with the door 18 in the open position and the other embodiment of the door stopper 88*b* attached to the door 18. In this embodiment, a portion of the door 18 is received in the door receiving region 206 (obstructed in this Figure) and clamped between the first extension 208 and the second extension 210 (obstructed in this Figure). The shelf 14 includes an optional opening 222 formed in the front ledge portion 96. FIG. 12*b* shows a side view of the door stopper 88*b* and the door 18 in the open position. Operation of the door stopper 88*b* will be described in more detail below.

Figure 13A:
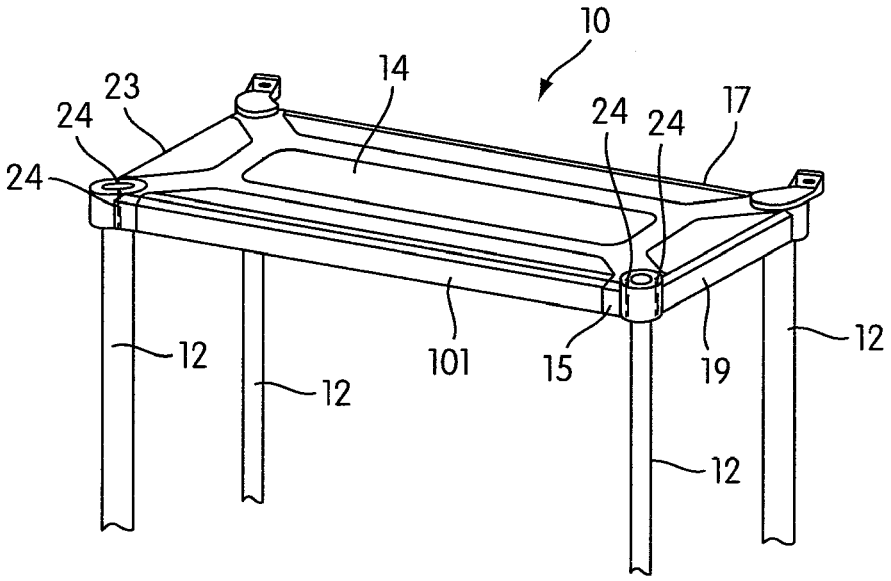
FIG. 13*a* is a perspective view of a portion of the shelving system.
Figure 13B:
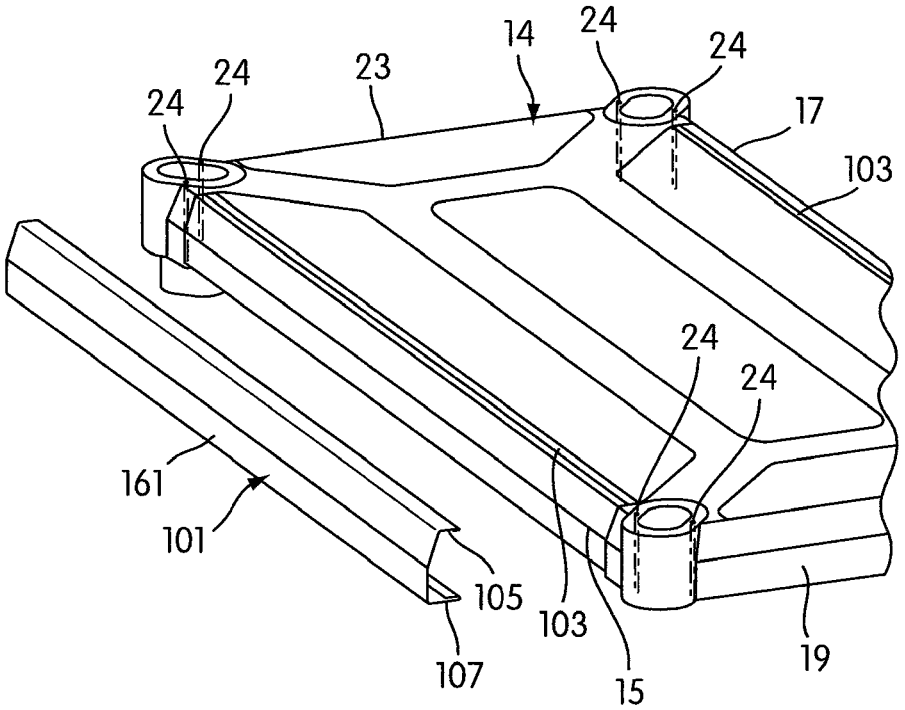
FIG. 13*b* is an exploded view of a portion of the shelving system with a shelf and metal guard.
Figure 13C:
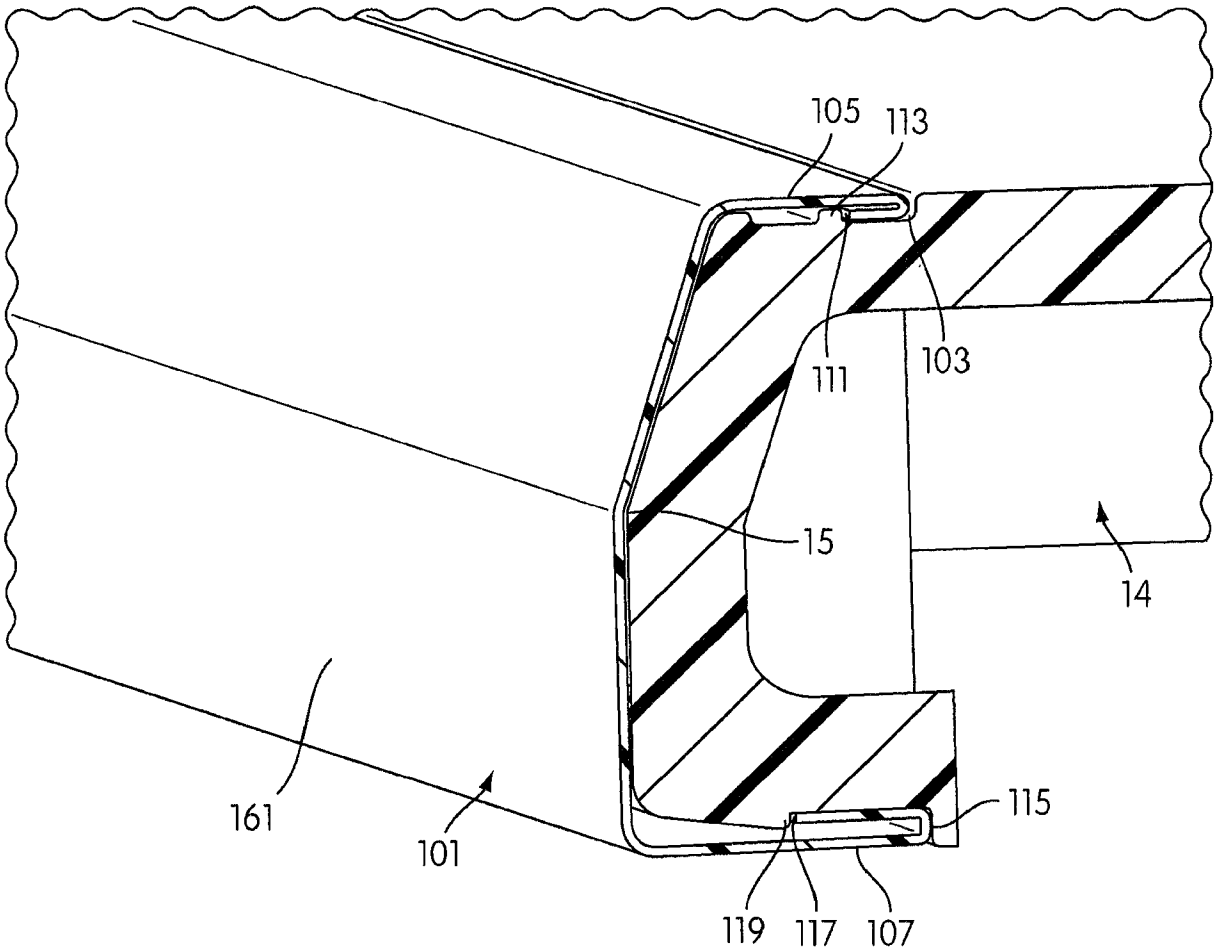
FIG. 13*c* is a detailed view of a portion of the metal guard and shelf of the shelving systems with certain parts removed to better reveal others.

FIG. 13*a* shows a portion of the shelving system 10 with a guard portion 101 attached to the shelf 14. It is contemplated that each shelf 14 may have a guard portion 101 attached thereon to strengthen and/or protect the shelves 14. The guard portion 101 may be connected to the front portion 15 and/or the back portion 17 of the shelf 14. As shown in FIG. 13*b*, the guard portion 101 may include a first end 105, a second end 107, and an intermediate portion 161 connecting the first and second ends 105, 107. The guard portion 101 may be a single piece of metal sheet or may be separate pieces attached together. It should be appreciated that in other embodiments, the guard portion 101 may be made of other materials, such as plastic, elastomer, or other materials. As shown in FIG. 13*b*, upper grooves 103 and lower grooves 115 (see FIG. 13*c*) may be formed near the front portion 15 and the rear portion 17 and extend along the width of the shelf 14. The grooves 103, 115 may be constructed and arranged to receive portions of the metal portion 101. As shown in FIG. 13*c*, the ends 105, 107 of the guard portion 101 may be folded inward and received in the grooves 103, 115 of the shelf 14. In the embodiment shown in FIG. 13*c*, an end portion 111 of the first end 105 may abut against a ridge 113 provided near the upper groove 103 and an end portion 117 of the second end 107 may abut against a ledge 119 formed near the lower groove 115. Accordingly, in some embodiments, to connect the guard portion 101 to the shelves 14, the guard portions 101 may be snapped into the shelves 14 such that the folded portion of the first end 105 is retained within the upper groove 103 and the folded portion of the second end 107 is retained within the lower groove 115. The ridge 113 may abut against the end portion 111 of the first end 105 and the ledge 119 may abut against the end portion 117 of the second end 107 to prevent removal of the guard portion 101 from the shelf 14 after the guard portion 101 is attached thereto.

Figure 14:
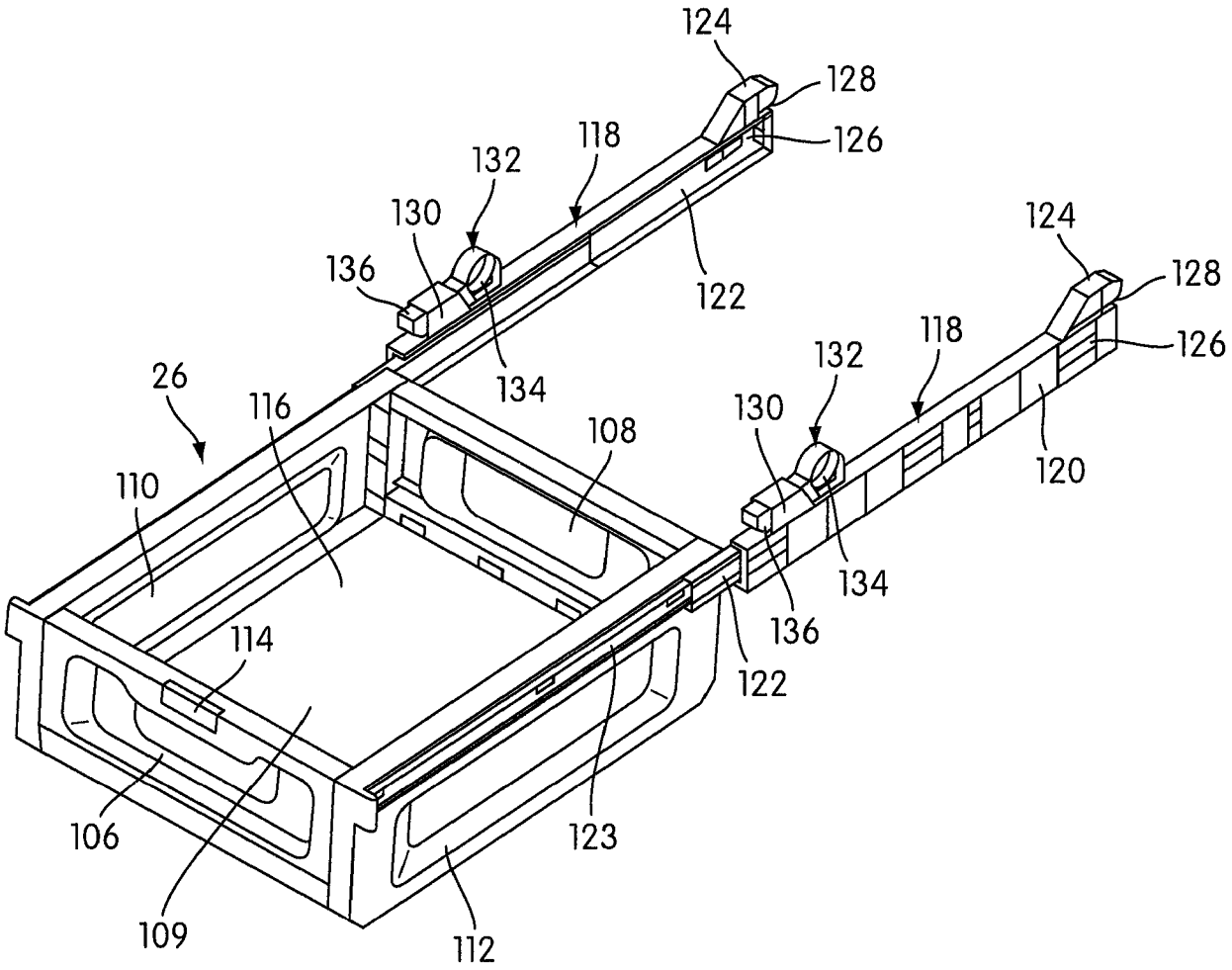
FIG. 14 is a perspective view of a drawer and slides of the shelving system in accordance with an embodiment.
Figure 15A:
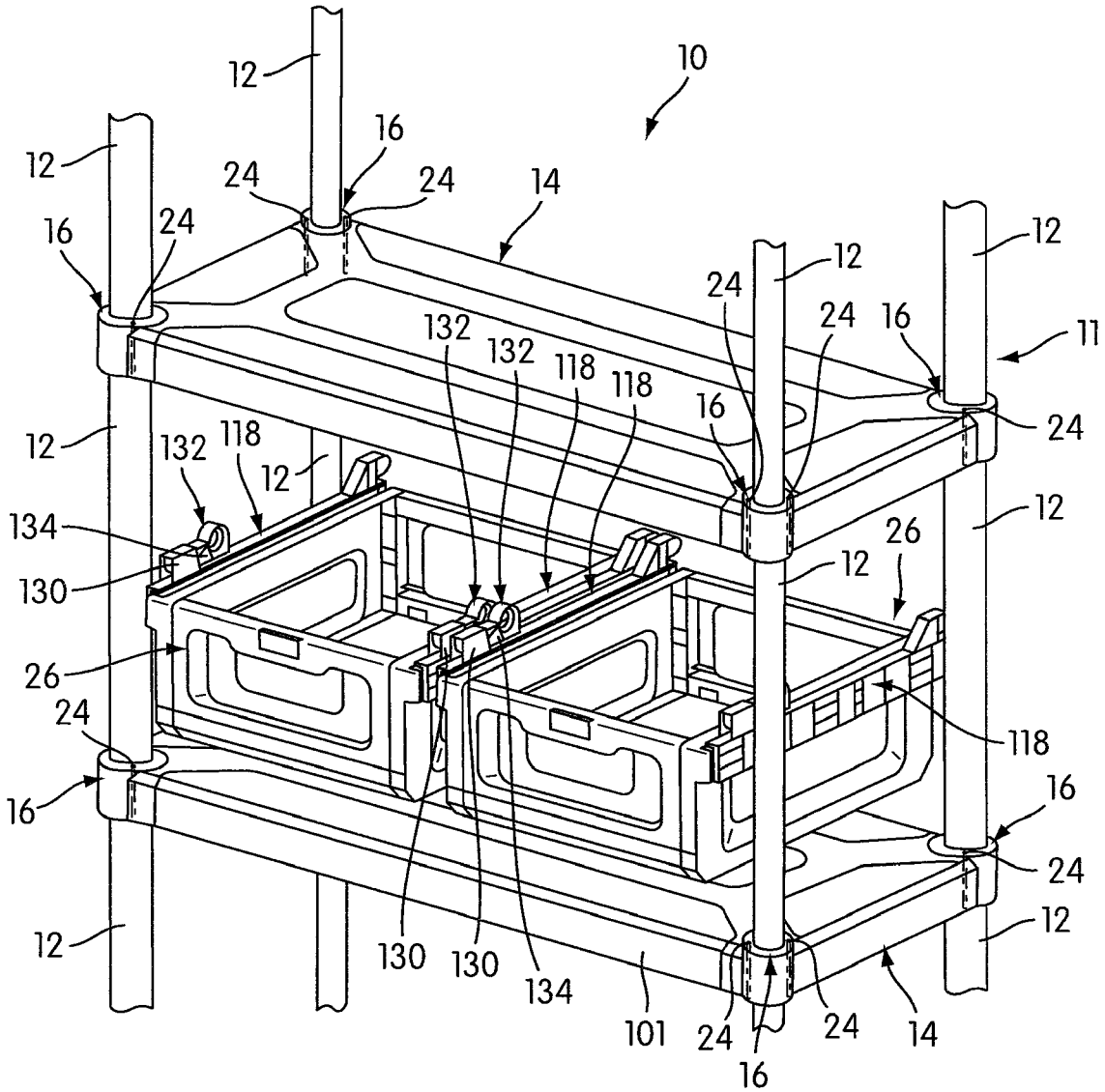
FIG. 15*a* is a perspective view of the drawer and slides of the shelving system disconnected from a shelf in accordance with an embodiment.
Figure 15B:
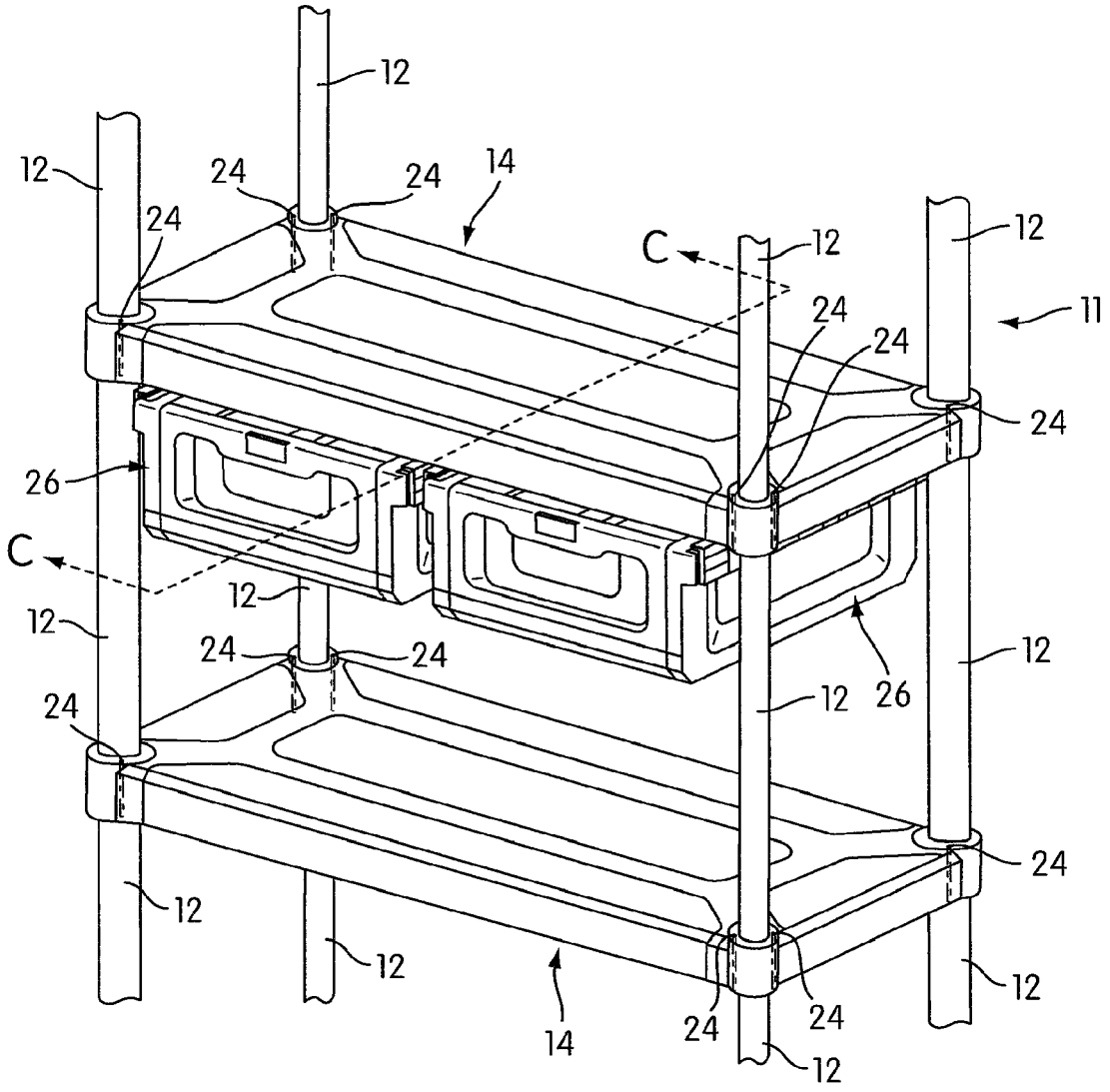
FIG. 15*b* is a perspective view of the drawer and slides of the shelving system connected to the shelf in accordance with an embodiment.

FIG. 14 shows a perspective view an embodiment of the drawer 26. As shown in this Figure, the drawer 26 includes a front wall 106, a rear wall 108, a left side wall 110, a right side wall 112, and a base 109. A handle 114 may be provided on the front wall 106 to facilitate opening or closing of the drawer 26 between an open position wherein access to an interior space 116 of the drawer 26 is permitted and a closed position wherein access to the interior space 116 of the drawer 26 is prevented. Slides 118 may be constructed and arranged to be connected to the assembled shelving system 10 after the shelving system has been assembled, and the drawer 26 may be operatively connected to the slides 118 to enable sliding movement of the drawer 26 between the open and closed positions. Thus, in the open position, the drawer 26 may be positioned relative to the slide 118 as shown in FIG. 14. In the closed position, the drawer 26 may be positioned relative to the slide 118 as shown in FIG. 15*a*. The slides 118 may include a frame 120, which may be made of integrally molded plastic, and a first slide member 122 that may be received in the frame 120. The first slide member 122 may be attached to the frame 120 and a second slide member 123 may be attached to the sides 110, 112 of the drawer 26 to enable sliding movement of the drawer 26 relative to the frame 120. In some embodiments, the frame 120 may not be provided and the slides 22 may be directly connected to the shelves 14. In some embodiments, the slides 22 may be made of plastic or may be ball bearing slides. In one embodiment, the first slide member 122 and the second slide member 123 may be made of plastic and may be constructed and arranged to slidingly mate with one another. It should be appreciated that the slides 22 may be made of any materials and may be any of type of slide that enables sliding movement between the drawers 26 and the shelves 14.

In the embodiment shown in FIG. 14, the frame 120 of the slides 118 includes a connector member taking the form of a hook 124 extending from a rear portion 126 thereof. A recess 128 may be defined between the hook 124 and the rear portion 126, the recess 128 being constructed and arranged to receive a slide support structure, taking the form of a rear ledge portion 125 (see FIG. 16*b*) of the shelf 14 in some embodiments, when the frame 120 is attached to the shelf 14. In one embodiment, the rear ledge portion 125 of the shelf 14 may be a portion that is folded inward away from the rear portion 17 of the shelf 14. The frame 120 may also include an extension portion 130 extending from a top surface thereof. The extension portion 130 is constructed and arranged to receive a slideable connector member 132 that is slideable between a locked position (see FIG. 16*b*) wherein the slideable connector member 132 retains the slide 118 on a slide support structure of the shelf 14, taking the form of the front ledge portion 96 (see FIG. 16*b*) of the shelf 14 in some embodiments, and an unlocked position (see FIG. 16*a*) wherein the slide 118 is releasable from the slide support structure of the shelf 14. The slideable connector member 132 may include an opening 134 therein to facilitate sliding movement of the slideable connector member 132, which will be described in more detail later. The slideable connector member 132 may also include a retainer portion 136 constructed and arranged to contact a portion of the shelf 14 to help retain the slide 118 on the shelf 14 in a hanging position, for example, as shown in FIG. 16*b*. It also be appreciated that in some embodiments, the slideable connector member 132 may be operatively connected to a biasing member (not shown) configured to bias the connector member 132 in either the locked or unlocked position. The operation of the slideable connector member 132 will be described in more detail later.

FIG. 15*a* shows the drawer 26 and the slides 118 disconnected from the shelves 14. Although two drawers 26 are shown in this embodiment, it is contemplated that the number of drawers 26 connected to the shelves 14 may vary in other embodiments. The size and configuration of the shelves 14 may also vary in other embodiments.

Figure 16A:
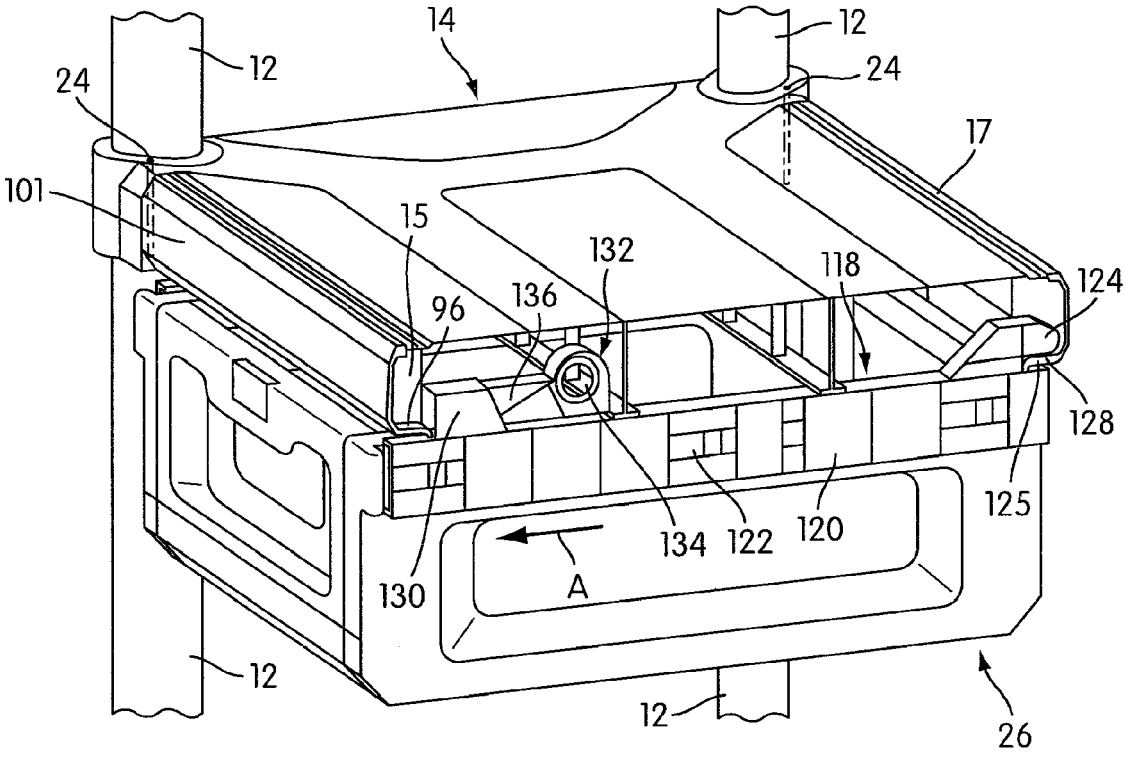
FIG. 16*a* is a detailed view of the drawer and shelf of the shelving system with the drawer disconnected from the shelf with certain parts removed to better reveal others.
Figure 16B:
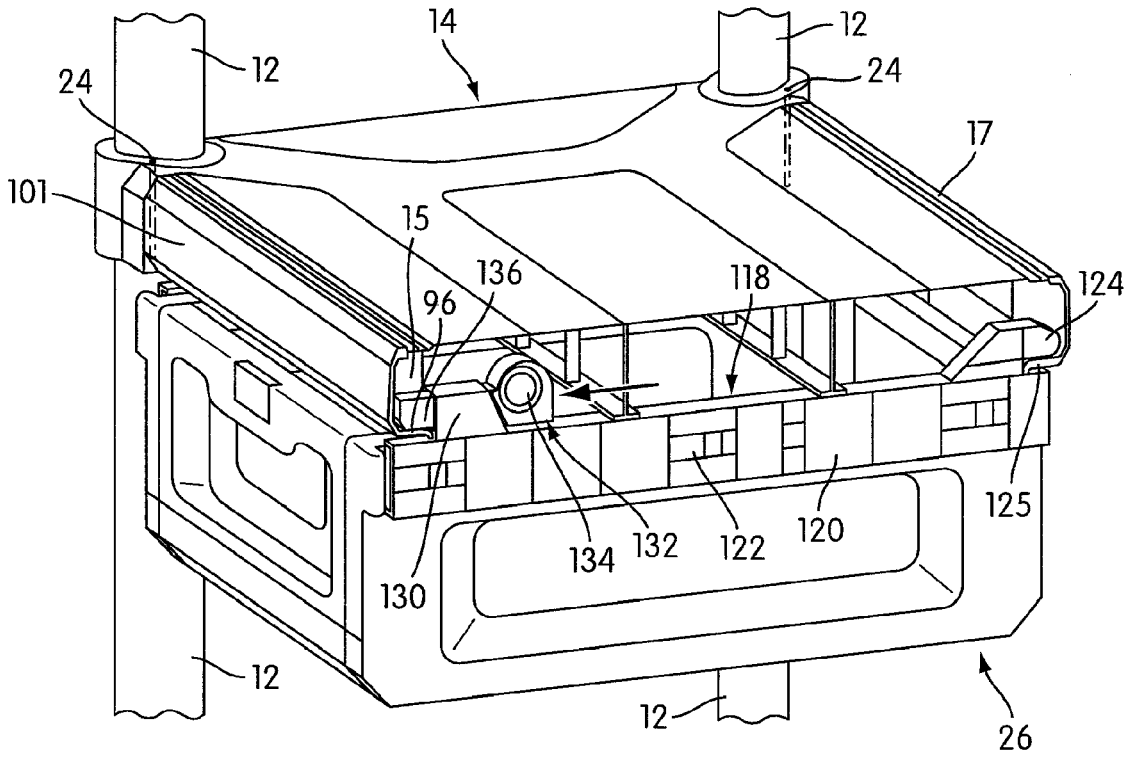
FIG. 16*b* is a detailed view of the drawer and shelf of the shelving system with the drawer connected to the shelf with certain parts removed to better reveal others.

FIG. 16*a* shows the slideable connector member 132 of the slide 118 in the unlocked position. As shown in FIG. 16*a*, the retainer portion 136 of the slideable connector member 132 is removed from the front ledge portion 96. Thus, the slides 118 are only connected to the shelves 14 by the placement of the rear ledge portion 125 of the rear portion 17 of the shelf 14 in the recess 128 of the hook 124. To connect the drawer 26 to the shelf 14 such that the drawer 26 hangs from the shelf 14, the slideable member 132 should be in the locked position, as shown in FIG. 16*b*, wherein the retainer member 136 is disposed on the front ledge portion 96.

Figure 17A:
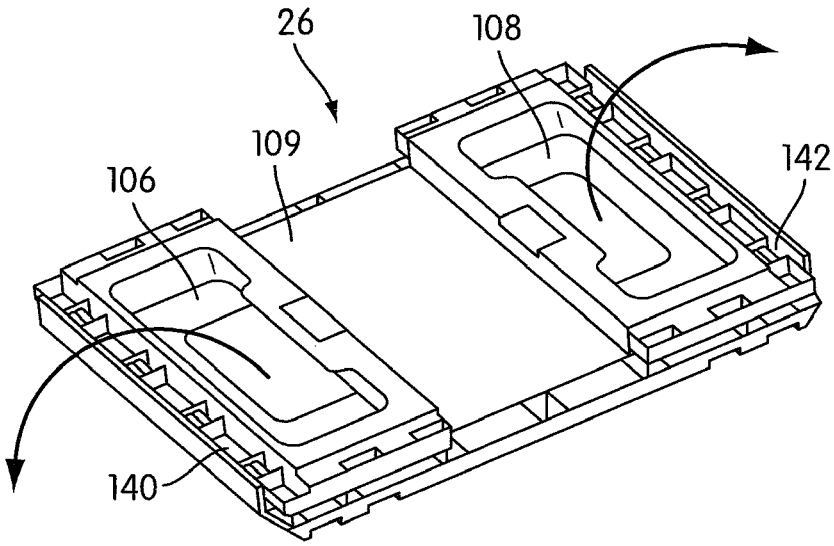
FIGS. 17*a*-17*b* show components of the drawer in accordance with an embodiment.
Figure 17B:
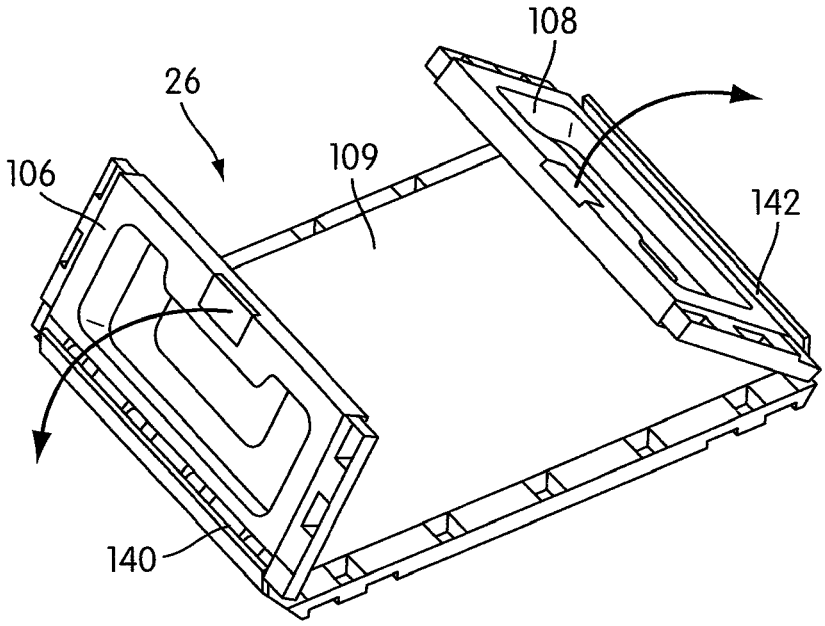
Figure 18A:
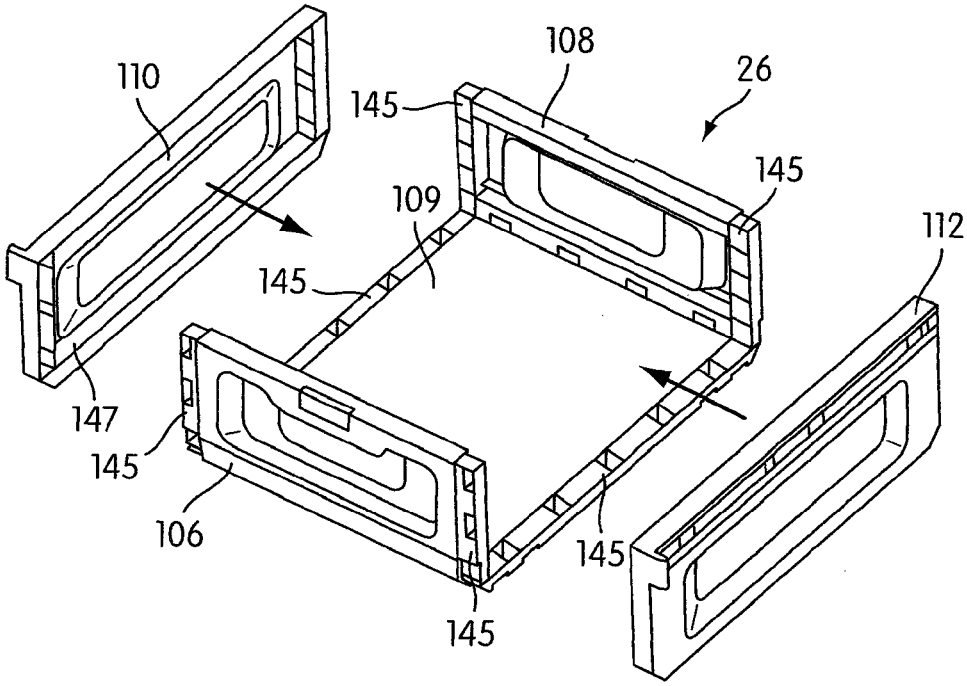
FIGS. 18*a*-18*b* illustrate assembly of the drawer in accordance with an embodiment.
Figure 18B:
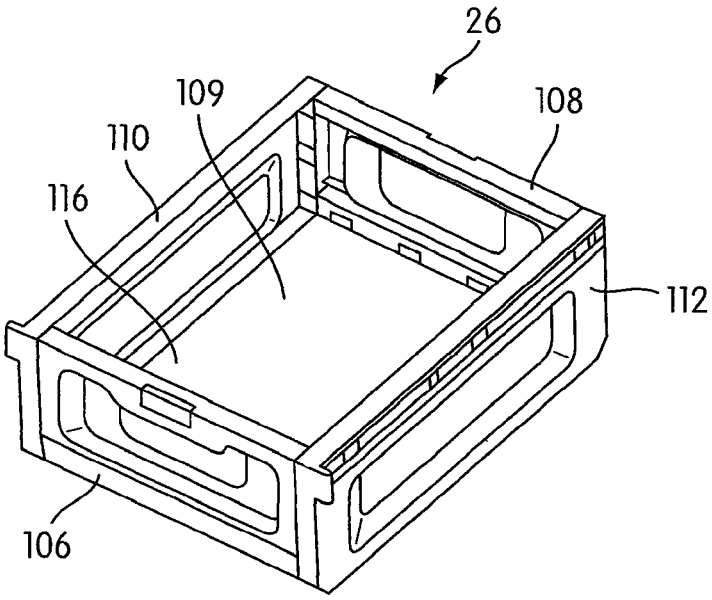

FIGS. 17*a* and 17*b* illustrate portions of the drawer 26 in accordance with an embodiment. FIG. 17*a* shows the drawer 26 in the folded position wherein the front wall 106 and rear wall 108 of the drawer 26 is folded onto the base wall 109 such that the front wall 106 and the rear wall 108 are disposed on top of the base wall 109. In this position, the drawer 26 may be easily transported or stored after manufacture and may be space efficient during transport or storage. The front wall 106 and/or rear wall 108 may be pivotally connected to the base wall 109. For example, in the embodiment shown in FIG. 17*a*, the front wall 106 is foldable or pivotable relative to the base wall 109 via a hinge 140. The rear wall 108 is also foldable or pivotable relative to the base wall 109 via a hinge 142. The hinges 140, 142 may have the same configuration. The hinges 140, 142 may be living hinges, snap-fit hinges, or other type of hinges. FIGS. 18*a*-18*b* show the front and rear walls 106, 108 in the upright position and the connection of the left and right walls 110, 112 thereto to form the drawer 26. As shown in FIG. 18*a*, the front wall 106, base wall 109, and rear wall 108 may include connecting portions 145 on the sides thereof. The connecting portions 145 may be constructed and arranged to be connected to receiving portions 147 formed on the side walls 110, 112 (the receiving structure 147 of the side wall 112 is obstructed from view in this Figure) to connect the side walls 110, 112 to the front wall 106, base wall 109, and rear wall 108.

Figure 19A:
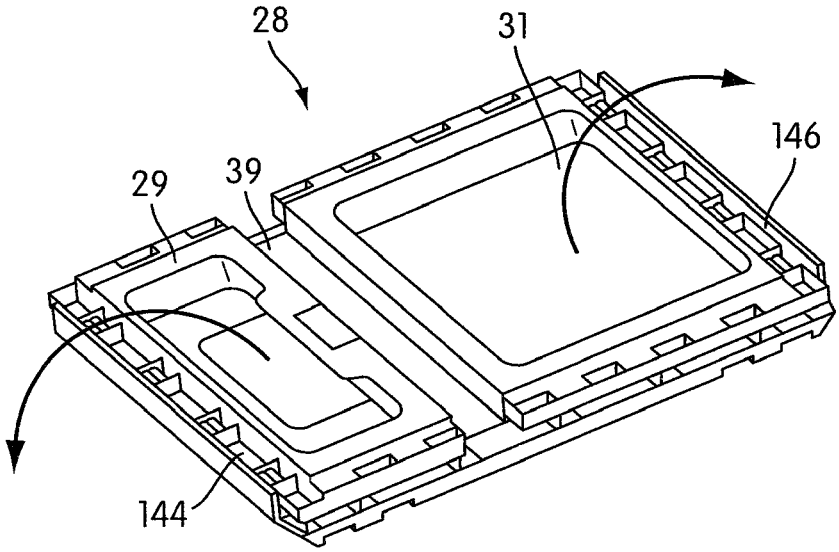
FIGS. 19*a*-19*c* show components of a bin in accordance with an embodiment.
Figure 19B:
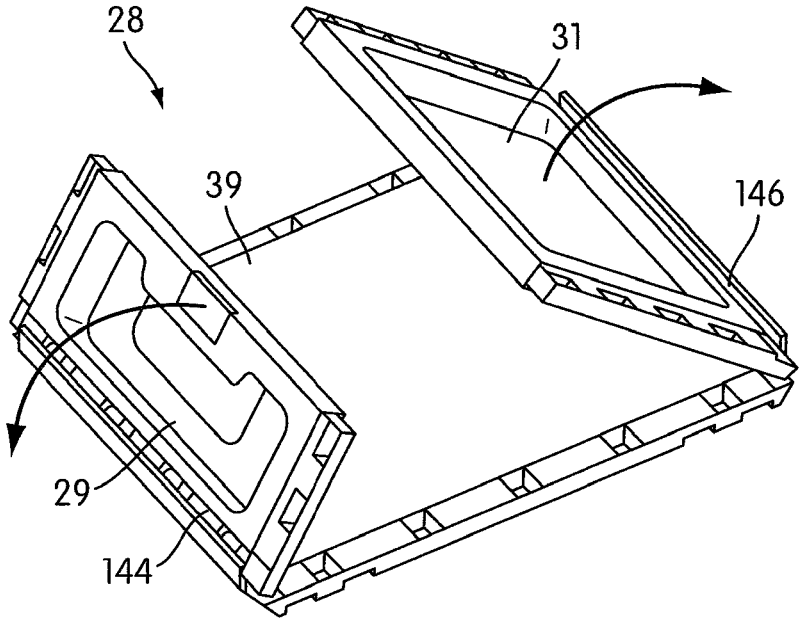

FIGS. 19*a*-19*b* illustrate portions of the bin 28. FIG. 19*a* shows the bin 28 in the folded position wherein the front wall 29 and the rear wall 31 are folded onto the base wall 39 such that the front wall 29 and the rear wall 31 are disposed on top of the base wall 39. In this position, the bin 28 may be easily transported or stored after manufacture and may be space efficient during transport or storage. In the embodiment shown in FIG. 19*a*, the front wall 29 is foldable relative to the base wall 39 via a hinge 144. The rear wall 31 is also foldable relative to the base wall 39 via a hinge 146. The hinges 144, 146 may be living hinges, snap-fit hinges, or other type of hinges. In the embodiment shown in FIG. 19*c*, the hinges 144, 146 are formed using snap-fit connections.

Figure 19C:
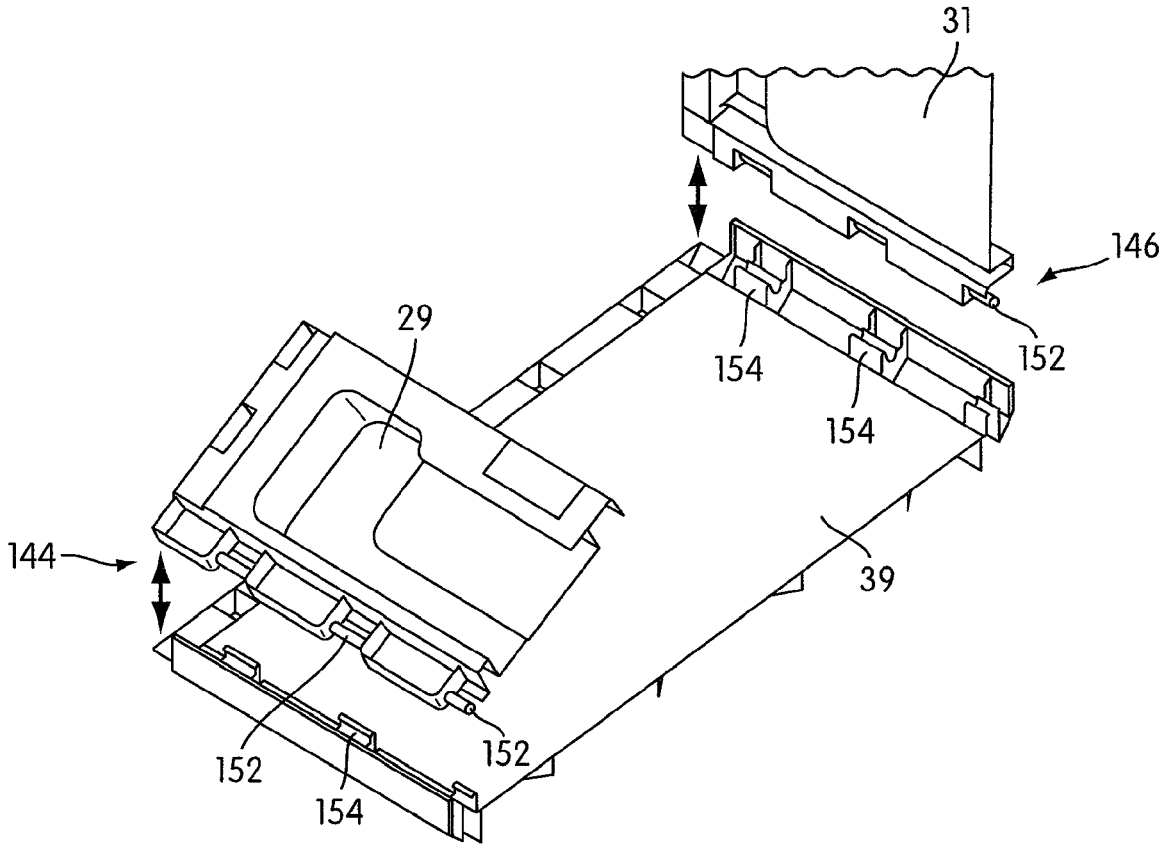
Figure 21A:
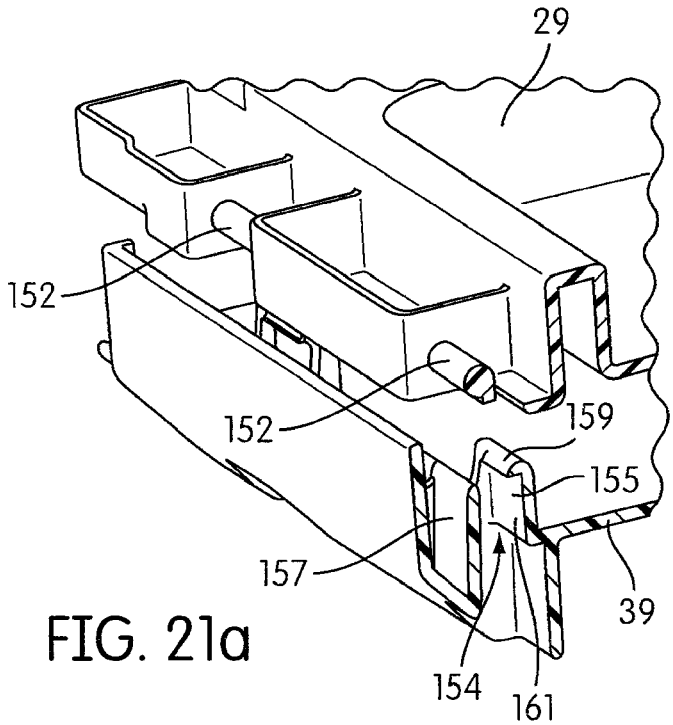
FIGS. 21*a*-21*c* are side cross sectional views of portions of the bin in accordance with an embodiment.

For example, as shown in FIG. 19*c*, the front wall 29 and the back wall 31 may include integrally formed connector structures 152. The integrally formed connector structures 152 may take the form of an axle or a rod constructed and arranged to be received in corresponding receiving structures 154 (see FIG. 21*a* for better view) integrally formed in the base wall 39. As shown in FIG. 21*a*, the receiving structures 154 may include a front portion 157 and a rear portion 155 defining a receiving space 161 therebetween. The receiving space 161 is constructed and arranged to receive the connector structure 152. In one embodiment, the connector structures 152 may be snap-fitted into the receiving space 161 defined by the front and rear portions 157, 155 of the receiving structures 154. A ledge 159 may be provided on the rear portion 155 to help retain the connector structure 152 within the receiving space 161, which will be described in more detail later.

Figure 21B:
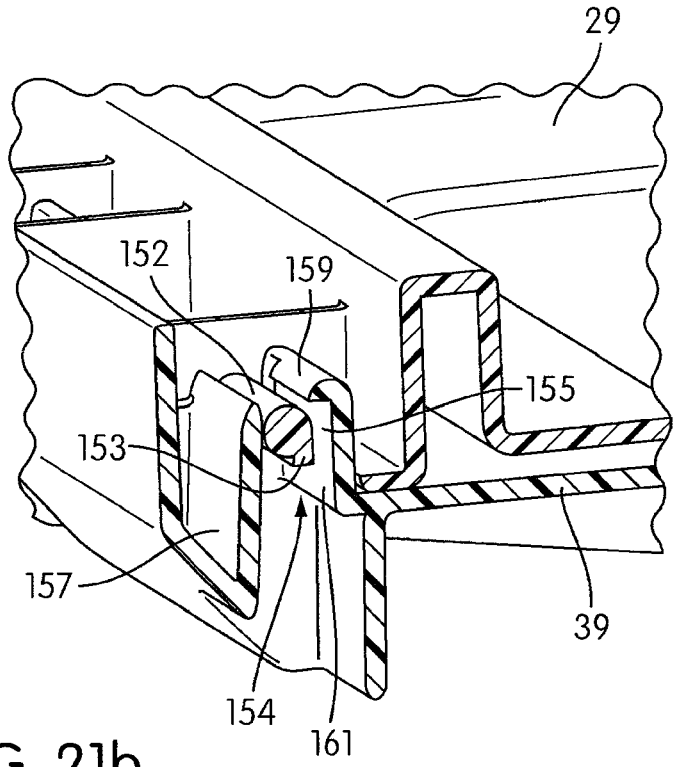
Figure 21C:
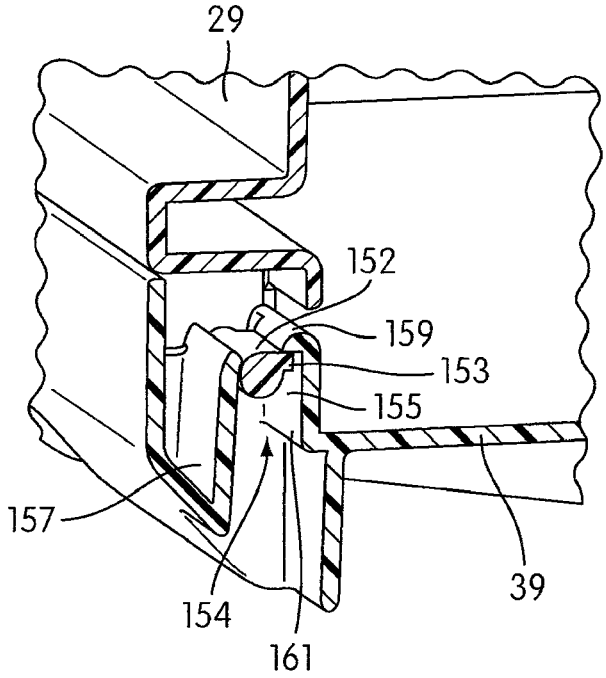

FIG. 21*b* shows the front wall 29 folded onto the base wall 39. In this embodiment, to enable the connecting structure 152 to be inserted into the receiving space 161, the front wall 29 may be folded onto the base wall 39 such that an extension portion 153 of the connecting structure 152 is extending in an opposite direction away from the ledge 159 of the rear portion 155. The front wall 29 may then be pivoted to its upright position, as shown in FIG. 21*c*, which also rotates the connecting structure 152. Accordingly, the connecting structure 152 may be rotated until the extension portion 153 abuts against the ledge 159 of the rear portion 155 of the receiving structure 154, thus retaining the connecting structure 152 within the receiving structure 154. To disconnect the connecting structure 152 from the receiving structure 154, the front wall 29 may be folded onto the base wall 39 again, as shown in FIG. 21*b*, thus also rotating the connecting structure 152 until the extension portion 153 of the connecting structure 152 is no longer abutting against the ledge 159. The connecting structure 152 may then be pulled out of or removed from the receiving space 161 of the receiving structure 154. Accordingly, the front wall 29 may be disconnected from the base wall 39.

It is contemplated that the connector structures 152 and the receiving structures 154 on the front and rear walls 29, 31 and the base wall 39 may be interchanged. It is contemplated that the hinges 140, 142 of the drawer 26 may have a similar configuration as the hinges 144, 146 of the bin 28. Thus, the hinges 140, 142 of the drawer 26 may have similar connecting structures and receiving structures as the bin 28 described above and the connecting structures and the receiving structures of the drawer 26 may operate in a similar manner as the connecting structures 152 and receiving structures 154 of the bin 28.

Figure 20A:
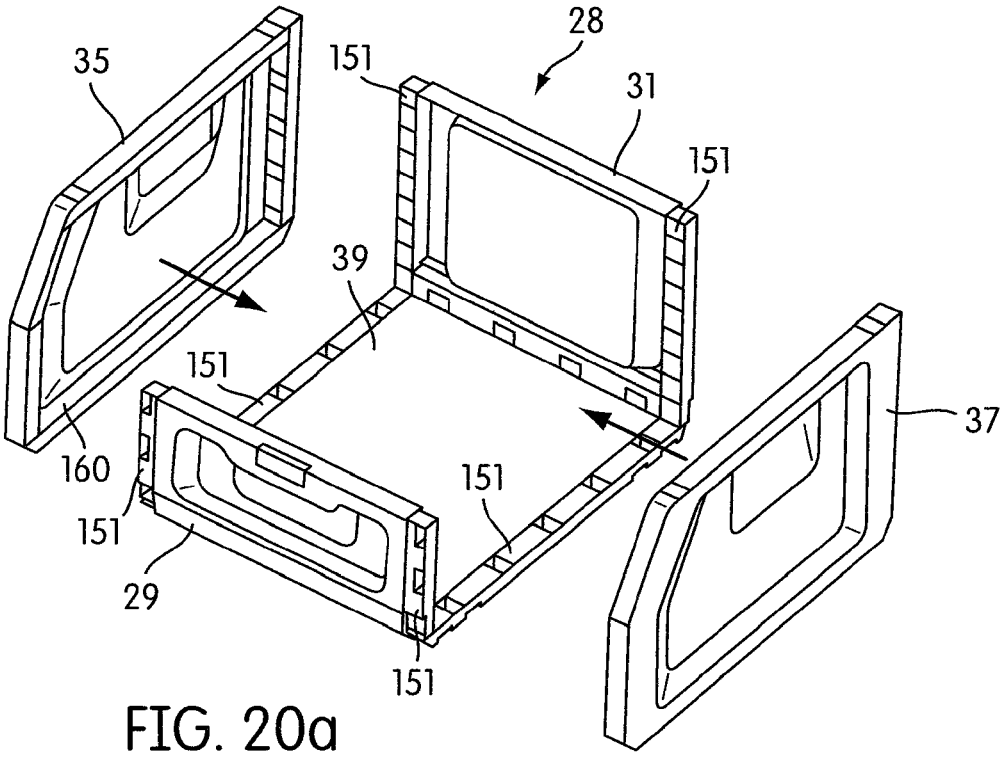
FIGS. 20*a*-20*b* illustrate assembly of the bin in accordance with an embodiment.
Figure 22A:
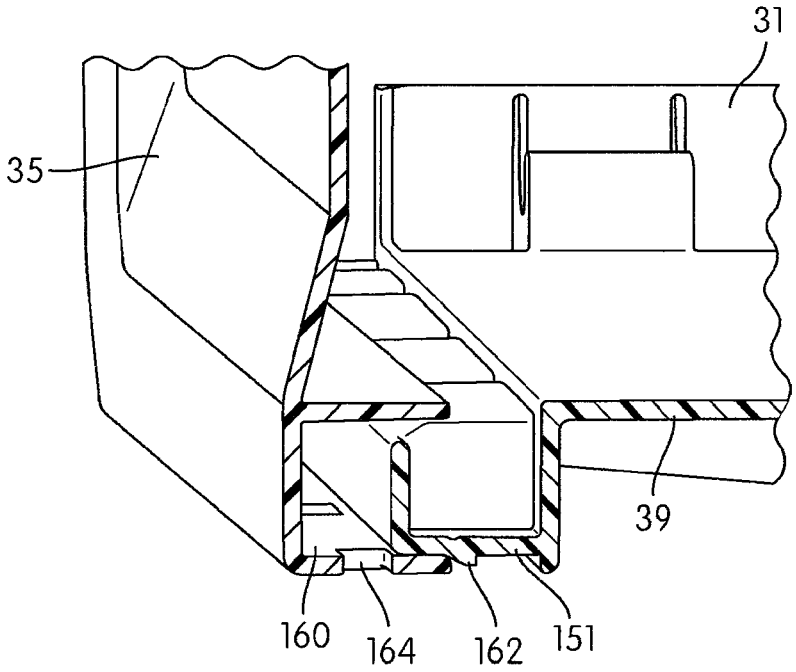
FIGS. 22*a*-22*b* are side cross sectional views of a portion of the bin in accordance with an embodiment.
Figure 22B:
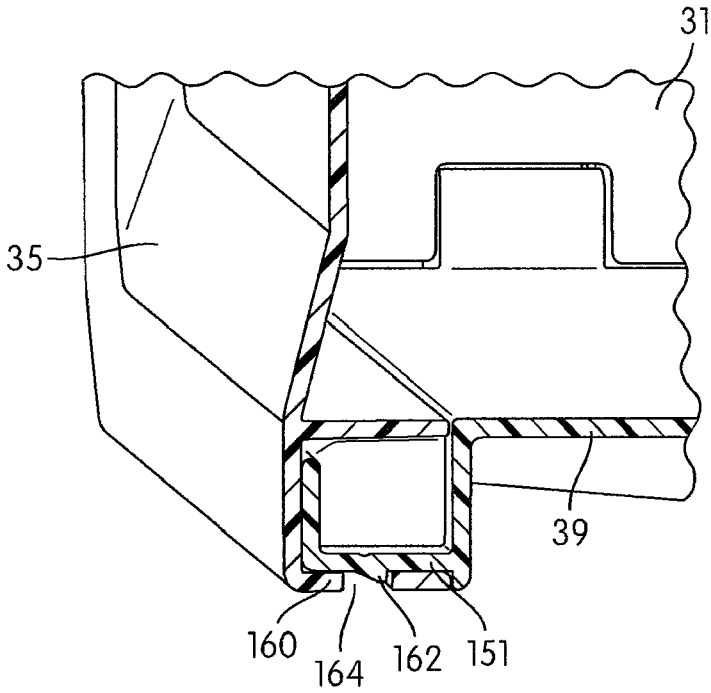
Figure 22C:
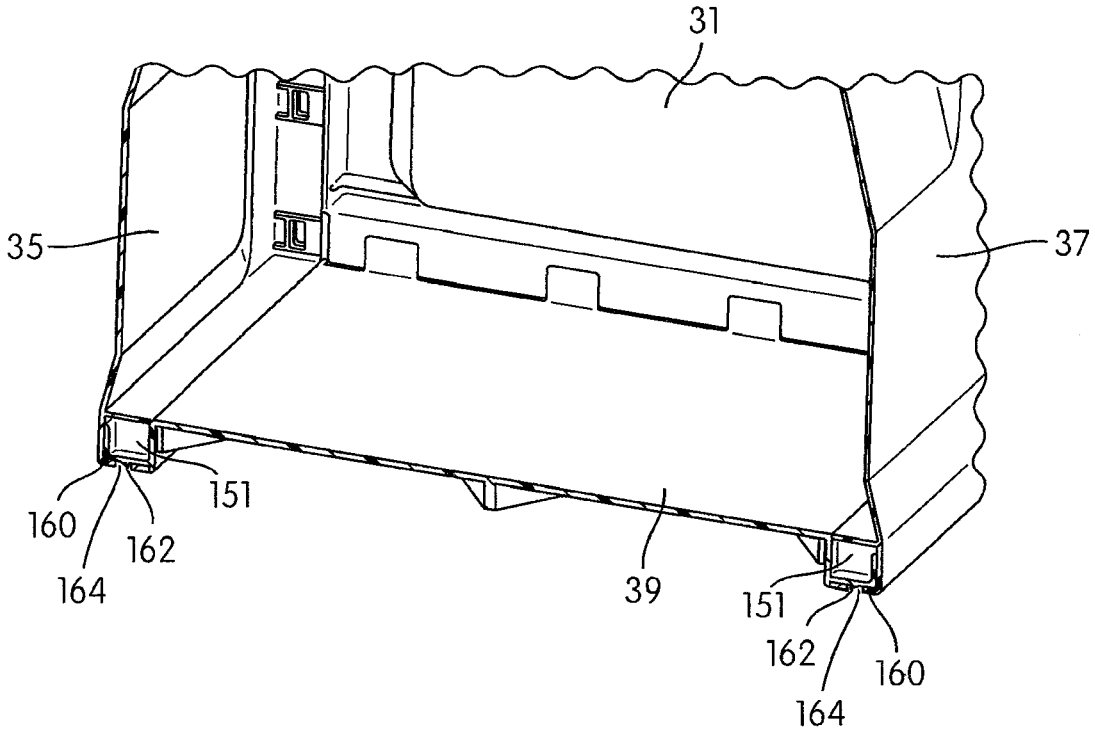
FIG. 22*c* is a front cross sectional view of a portion of the bin in accordance with an embodiment.

In the embodiment shown in FIG. 20*a*, the front wall 29, base wall 39, and rear wall 31 may be provided with connecting portions 151 on the side thereof. The connecting portions 151 may be constructed and arranged to be received in receiving portions 160 provided on the side walls 35, 37 (the receiving portion 160 of the side wall 37 is obstructed from view in this Figure) to connect the side walls 35, 37 to the front wall 29, base wall 39, and rear wall 31. FIGS. 22*a*-22*b* show the connecting portion 151 and the receiving portion 160 in more detail. As shown in FIG. 22*b*, the connecting portion 151 includes a protrusion 162 constructed and arranged to be received in an opening 164 formed in the receiving portion 160. The protrusion 162 of the connecting portion 151 is constructed and arranged to abut against a portion of the receiving portion 160 of the side wall 35 surrounding the opening 164 to prevent the connecting portion 151 from being disconnected from the receiving portion 160. As shown in FIG. 22*c*, the receiving portion 160 of the side wall 37 may have the same configuration as the receiving portion 160 of the side wall 35 and may be connected to the connecting portion 151 in a similar manner, which will be described in more detail below. In one embodiment, the connecting portions 145 of the drawer 26 may have a similar configuration as the connecting portion 151 of the bin 28 described above. Furthermore, the receiving portions 147 of the drawer 26 may have a similar configuration as the receiving portion 160 of the bin 28 described above. The receiving portions 147 and the connecting portions 145 of the drawer 26 may be connected to one another in a similar manner as the connecting portions 151 and the receiving portions 160 of the bin 28, which will be described in more detail later. The shelving assembly 10 may be assembled in accordance with an embodiment as follows. A shelf 14 may be selected as the top most shelf 14 and the upper ends 48 of the frame members 12 may be inserted into the openings 34 of the frame receiving regions 16 of the shelf 14 until the upper ends 48 abut against the flanges 52 of the frame receiving regions 34. In one embodiment, for example, as shown in FIG. 1, the insertion portion 42 of the wall supports 32 may be inserted into two of the frame receiving regions 34 nearest to the rear portion 17 of the shelf 14, and the insertion portions 38 of top covers 36 may be inserted into two of the other frame receiving regions 34. Accordingly, the openings 34 of the frame receiving regions 16 of the top most shelf 14 may each receive a frame member 12 and one of a wall support 32 or top cover 36. To assemble the other layers of the shelves 14, for example, as shown in FIG. 8, the lower ends 50 of the upper frame members 12*a* and the upper ends 48 of the lower frame members 12*b* may be inserted into the openings 34 of the frame receiving regions 16 until the ledges 51 of the upper frame members 12*a* abut against the flanges 52 and the upper ends 48 of the lower frame members 12*b* abut against the flanges 52. Accordingly, the lower ends 50 of the upper frame member 12*a* are telescopically received in the upper ends 48 of the lower frame members 12*b*. It is contemplated that additional layers of shelves 14 may be added to the shelving system 10 in a similar manner using the frame members 12 and the shelves 14.

To assemble the bottom most shelf 14, the lower end 50 of the frame members 12 may be inserted into the frame receiving regions 34 until the ledges 51 of the frame members 12 abut against the annular flange 52. The insertion portion 46 of the legs 53 may be inserted into the other ends of the openings 34 of the frame receiving regions 16 so that the legs 53 may help support and provide stability to the shelving system 10, as shown in FIG. 1.

After the shelving system 10 has been assembled, the closure members may be added to the shelving system 10 to form cabinet structures 30. Referring to FIGS. 8*a* and 8*c*, two rear walls 21 may be assembled together by turning one of the rear walls 21 upside down and connecting the two rear walls 21 in a jigsaw-puzzle like connection by inserting the pin 78 of a first rear wall 21 into the opening 80 of a second rear wall 21, and inserting the pin 78 of the second rear wall 21 into the opening 80 of the first rear wall 21. The closure members may be connected to the shelving system 10 as follows in accordance with an embodiment. Referring to FIG. 9*a*, the connector structures 22 of the door 18 and the connector structures 22 of the side wall 20 may be aligned with the connector structures 24 of the shelving system 10. In the embodiment shown in FIG. 9*a*, the connector structures 24 of the shelving system 10 is provided near or at the frame receiving regions 16 of the shelves 14. After the connector structures 22, 24 are aligned, lower portions 84 of the pins 82 may be inserted into the connector structures 22, 24 (which take the form of recesses in this embodiment) until the upper portions 86 of the pins 84 abut against the ledges 94 formed in the connector structures 22, as shown in FIG. 9*b*. The other connector structures 22, 24 may be connected in a similar manner. For example, it should be appreciated that the connector structures 22 of the rear walls 21 may be connected to the connector structures 24 of the shelving system 10 in a similar manner using the pins 82.

The door stopper 88*a* may be added to the shelving system 10 before or after the addition of the closure members. Referring to FIG. 11*a*, the door stopper 88*a* may be connected to the shelf 14 by pushing the door stopper 88*a* onto the front ledge portion 96 of the shelf 14 until the front ledge portion 96 is clamped between the upper portion 97 and the intermediate portion 99 of the door stopper 88*a*.

The door stopper 88*a* may operate as follows in accordance with an embodiment. Referring to FIG. 11*c*, the door stopper 88*a* may prevent the closing of the door 88*a* by the contact between the first portion 91 of the door stopper 88*a* and the ledge 102 of the door 18. To move the door 18 to the closed position, the door 18 may be pushed with sufficient force such that the ledge 102 is pushed against the first portion 91 until the first portion 91 flexes and is moved upwards. The ledge 102 may then clear the leaf spring 90 that is formed by the first and second portions 91, 93 such that the ledge 102 is located closer to the second portion 93 than the first portion 91, as shown in FIG. 11*d*. The resiliency of the leaf spring 90 enables the movement of the door 18 to the closed position when sufficient force is applied. The second portion 93 may prevent the door 18 from moving from the closed position to the open position by the contact between the second portion 93 and the ledge 102. In some embodiments, the frictional contact between at least a portion of the leaf spring 90 and at least a portion of the door 18 may help retain the door in the closed position. To move the door 18 to the open position, the door may be pulled 18 with sufficient force such that the ledge 102 is pushed against the second portion 93 until the second portion 93 flexes and is moved upwards. The ledge 102 may then clear the leaf spring 90 that is formed by the first and second portions 91, 93 such that the ledge 102 is located closer to the first portion 91 than the second portion 93, as shown in FIG. 11*c*. In embodiments using frictional contact to help retain the door 18 in the closed position, the door 18 may be pulled towards the open position with sufficient force to overcome the frictional contact between door stopper 88*a* and the door 18. It should also be appreciated that a door stopper similar to the door stopper 88*a* described above may be located on another shelf 14 and may be constructed and arranged to contact at least a portion of the bottom portion 58 of the door 18 to help retain the door 18 in the closed position. For example, in the embodiment shown in FIG. 8*b*, the door stopper (not shown in this Figure) may be located on the shelf 14*b* and may be constructed and arranged to contact the bottom portion 58 of the door 18. The door stopper may operate in a similar manner as the door stopper 88*a* described above.

Alternatively, the door stopper 88*b* may be connected to the upper portion 56 of the door 18 by pushing the door stopper 88*b* onto the door 18 until a portion of the door 18 is clamped between the first and second extensions 208, 210. The door stopper 88*b* may operate as follows in accordance with an embodiment. Referring to FIG. 12*b*, the door stopper 88*b* may prevent the door 18 from moving to the closed position by the contact between the inclined first portion 202 of the leaf spring 200 and the front ledge portion 96 of the shelf 14. To move the door 18 to the closed position, the door 18 may be pushed with sufficient force such that the leaf spring 88*b* is pushed against the front ledge portion 96 until the leaf spring 200 flexes and bends underneath the front ledge portion 96 to accommodate the movement of the door 18 to the closed position. Accordingly, the resilient contact between the leaf spring 200 and the front ledge portion 96 of the shelf 14 can provide sufficient friction so as to prevent the door from moving to the open position. Furthermore, in one embodiment, a door stopper having the same configuration as the door stopper 88*b* may be provided on the lower portion 58 of the door 18. The door stopper (not shown) can be connected to the lower portion 58 of the door 18 in the same manner as described above with respect to the door stopper 88*b* and the upper portion 56 of the door 18. The contact between the door stopper on the lower portion 58 of the door 18 and another shelf 14 can provide sufficient friction so as to prevent the door from moving to the open position. Furthermore, opposing spring forces may be provided by the contact between the door stopper 88*b* on the upper portion 56 and the shelf 14 and the contact between the door stopper on the lower portion 58 and the other shelf 14. Accordingly, in one embodiment, for example as shown in FIG. 8*b*, the opposing spring forces may help retain the door 18 in the closed position between the shelves 14*a*, 14*b*. To move the door 18 to the open position, the door 18 may be pulled towards the open position with sufficient force to overcome the frictional contact between the door stopper 88*a* and the front ledge 96 of the shelf 14. The door stopper 88*a* can flex during this movement. In embodiments that also have the door stopper on the lower portion 58 of the door 18, the door 18 may be pulled with sufficient force towards the open position so as to also overcome the frictional contact between the door stopper and the other shelf 14. The door stopper may also flex during this movement.

In an alternative embodiment, when the door 18 is moved to the closed position, the leaf spring 200 may snap upward such that the junction 204 is received in the opening 222 of the front ledge portion 96. The insertion of the junction 204 into the opening 22 may help prevent the movement of the door 18 to the open position. To move the door 18 to the open position, the door 18 may be pulled towards the open position with sufficient force so as to bend the leaf spring 200 until the junction 204 is removed from the opening 222. In a further alternative embodiment, when the door 18 is moved to the closed position and the leaf spring 200 has cleared the front ledge portion 96, the leaf spring 200 may snap upward and the front ledge portion 96 of the shelf 14 may be located between the inclined second portion 204 and the vertical extension portion 214. Thus, at least portions of the leaf spring 200, such as the inclined second portion 204, may help prevent movement of the door 18 to the open position. To move the door 18 to the open position, the door 18 may be pulled to the open position with sufficient force such that the front ledge portion 96 contacts the inclined second portion 204 of the leaf spring 200 and causes the leaf spring 200 to bend and flex until the leaf spring 200 has cleared the front ledge portion 200. It should be appreciated that the embodiments of the door stoppers 88*a*, 88*b* described above are not intended to be limiting, and other embodiments of the door stopper may be used.

Figure 20B:
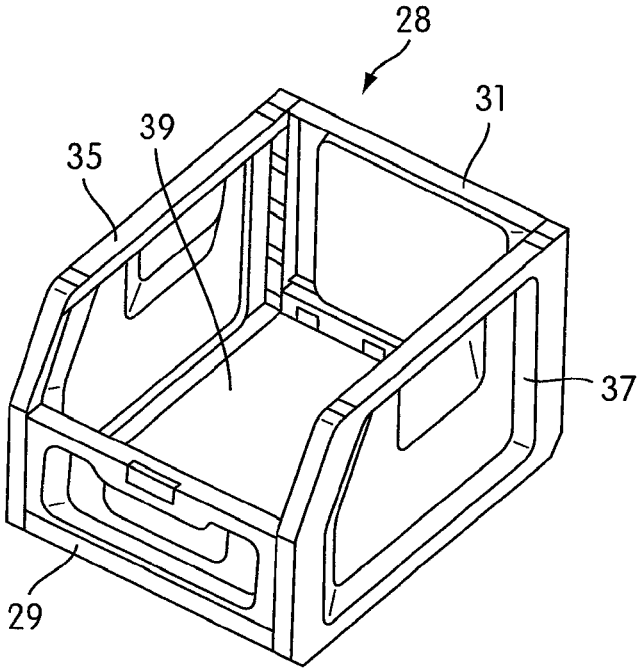

Drawers 26 and bins 28 may be added to the shelving system 10. The bins 28 may be assembled in accordance with an embodiment as follows. The bins 28 may initially be in a folded position, as shown in FIG. 19*a*. However, it is also contemplated that in some embodiments, the front and rear walls 29, 31 of the bins 28 may be disconnected from the base wall 39 during transport, for example as shown in FIG. 19*c*. In such embodiments, the front and rear walls 29, 31 may be connected to the base wall 39 by pushing the front and rear walls 29, 31 against the base wall 39 until the connector structures 152 are received in the receiving structures 154 formed on the base wall 39 to form the hinges 144, 146. However, in embodiments where the bins 28 are initially in the folded position as shown in FIG. 19*a*, the front and rear walls 29, 31 of the bins 28 may be folded away from the base wall 39 along the hinges 144, 146, respectively. The left and right walls 35, 37 may then be snap fitted to the front wall 29, base wall 39, and rear wall 31, as shown in FIG. 20*a*, via the connecting portions 151 and the receiving portions 160. To connect the connecting portion 151 to the receiving portion 160, the connecting portion 151 may be pushed towards the receiving portion 160, as shown in FIG. 22*a*. The connecting portion 151 of the base wall 39 may be pushed into the receiving portion 160 of the side wall 35 until the protrusion 162 of the connecting portion 151 snaps into the opening 164 of the receiving portion 160, as shown in FIG. 22*b* Similar protrusions 162 may also be provided on the connecting portions 151 of the front and rear walls 29, 31. The contact between the protrusion 162 and the portion of the receiving portion 160 surrounding the opening 164 prevents the connecting portion 151 from being disconnected from the receiving portion 160. The connecting portion 151 of the base wall 39 may be connected to the receiving portion 160 of the side wall 37 in a similar manner. FIG. 20*b* shows an embodiment of an assembled bin 28.

The drawers 26 may initially be in a folded position, as shown in FIG. 17*a*. The front and rear walls 106, 108 of the drawers 26 may be folded away from the base wall 109 along the hinges 140, 142, respectively. The left and right walls 110, 112 may then be snap fitted to the front wall 106, rear wall 108, and the base wall 109, as shown in FIG. 18*a*. The snap-fit connection may be provided by the connection between the connecting portions 145 and the receiving portions 147. The connecting portions 145 and the receiving portions 147 may be connected in a similar manner described above with respect to the connecting portions 151 and the receiving portions of the bin 28. FIG. 18*b* shows an embodiment of an assembled drawer 26. Slides 118 may be connected to the drawers 26 by attaching a portion of the ball bearing slides 122 to the left wall 110 and to the right wall 112 of the drawer 26. The other portions of the ball bearing slides 122 may be attached to the frame 120 of the slides 118. The drawers 26 and the slides 118 may be placed underneath the shelf 14 that the drawers 26 are to be attached to, as shown in FIG. 15*a*. The rear hooks 124 of the frames 120 may be hooked onto the rear ledge portion 125 of the shelves 14 such that the rear ledge portion 125 is received in the recess 128 of the hook 124, as shown in FIG. 16*a*. Initially, the slideable connector member 132 should be in the unlocked position, as shown in FIG. 16*a* so that the slideable connector member 132 may clear the front ledge portion 96 when the drawer 26 and slides 118 are lifted to the position shown in FIG. 16*a*. To connect the drawer 26 and the slides 118 to the shelf 14 such that the drawer 26 hangs from the shelf 14, the slideable connector member 132 is pushed in the direction of A. It is contemplated that the drawer 26 may be in the open position such that a user may access the slideable connector member 132 through the interior space 116 of the drawer 26 to push the slideable connector member 132 forward. After the slideable connector member 26 is pushed forward in the direction of A, the slideable connector member 26 is in the locked position, as shown in FIG. 16*b* wherein the retainer portion 136 rests on the front ledge portion 96 of the shelf 14. The connector member 132 is received in the extension portion 130 of the frame 120 of the slides 118 and thus the slides 118 (and also the drawer 26) may hang on the shelf 14 using the connector member 132. Accordingly, the slides 118 and the drawer 26 are supported on the shelf 14 by the connection between the hook 124 and the rear ledge portion 125 and by the connection between the slideable connector member 132 and the front ledge portion 96.

To disconnect the drawer 26 from the shelf 14, the slideable connector member 132 may be pushed in the direction opposite that of A using the opening 134 of the slideable connector member 132 to facilitate the movement of the connector member 132. After the slideable connector member 132 is moved to the unlocked position as shown in FIG. 16*a* wherein the retainer portion 136 of the slideable connector member 132 no longer rests on the front ledge portion 96, the hook 124 may be disconnected from the rear ledge portion 125. Accordingly, the drawers 26 and the slides 118 may be removed from the shelf 14, as shown in FIG. 15*a*.

It should be appreciated that the above described examples of various configurations of the shelving system 10 are not intended to be limiting. The shelving system 10 may include a variety of other configurations in other embodiments. Combinations of any of the drawers 26, bins 28, closure members, or other components may be retrofitted to the shelving system 10 after manufacture. For example, customers who purchase the shelving system 10 may configure a shelving system 10 by adding any of the drawers 26, bins 28, closure members, or other components. These retrofittable components may also be removed at any time to re-configure the shelving system 10.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A shelving system comprising:

a plurality of tubular frame members;

a plurality of shelves, the shelves having frame receiving regions arranged to receive ends of the tubular frame members, wherein the plurality of shelves and the plurality of tubular frame members are connectable by insertion of the tubular frame members into the frame receiving regions to form an openly configured, assembled shelving unit in which the shelves are connected to one another in vertically spaced relationship by the frame members; and at least one closure member;

the assembled shelving unit and the at least one closure member both having an integrally molded connector structure that provides for connectability of the at least one closure member to the assembled shelving unit with the tubular frame members received by the frame receiving regions, wherein, after the tubular frame members are received in the frame receiving regions to form the assembled shelving unit, the integrally molded connector structure of the assembled shelving unit remains available, without removing the tubular frame members from the frame receiving regions of the assembled shelving unit, for connection with the integrally molded connector structure of the at least one closure member, such that connection of the at least one closure member to the assembled shelving unit positions the at least one closure member between two of the shelves of the assembled shelving unit, wherein each of the plurality of shelves includes a front portion, a rear portion, and opposed side portions, wherein each of the plurality of shelves includes corner portions disposed at intersections of the front portion with the opposed side portions and at intersections of the rear portion with the opposed side portions, and wherein each of the corner portions includes the integrally molded connector structures that provide for connectability of the at least one closure member to the assembled shelving unit and also includes the frame receiving regions that provide for connectability of the tubular frame members to the corresponding shelves to form the assembled shelving unit, and wherein each of the corner portions protrude outwardly beyond the front portion and side portion or rear portion and side portion which intersect at each respective corner portion.

2. The shelving system of claim 1, further comprising pins constructed and arranged to connect the integrally molded connector structure of the at least one closure to the integrally molded connector structure of the shelving unit.

3. The shelving system of claim 2, wherein the integrally molded connector structure of the at least one closure and the integrally molded connector structure of the assembled shelving unit comprise recesses, and wherein the pins are constructed and arranged to be received in the recesses to connect the at least one closure to the assembled shelving unit.

4. The shelving system of claim 1, wherein the at least one closure member comprises at least one door.

5. The shelving system of claim 4, further comprising a retainer member constructed and arranged to retain the door in a closed position.

6. The shelving system of claim 5, wherein the retainer member comprises a leaf spring.

7. The shelving system of claim 1, wherein the at least one closure member comprises at least one wall.

8. The shelving system of claim 1, wherein the integrally molded connector structure of the assembled shelving unit is molded into the shelves.

9. The shelving system of claim 8, wherein the integrally molded connector structure of the assembled shelving unit is formed adjacent the frame receiving regions of the shelves.

10. The shelving system of claim 1, wherein the plurality of tubular frame members is made of molded plastic.

11. The shelving system of claim 1, wherein the plurality of shelves is made of molded plastic.

12. The shelving system of claim 1, wherein the at least one closure member is made of molded plastic.

13. The shelving system of claim 1, further comprising:

a drawer constructed and arranged to be operatively connected to one of the plurality of shelves, and a drawer slide comprising a first slide member and a second slide member, the first slide member being constructed and arranged to be connected to the one of the plurality of shelves and the second slide member being constructed and arranged to be connected to the drawer so as to enable the drawer to be slideable relative to the one of the plurality of shelves.

14. The shelving system of claim 13, wherein the first slide member is attached to a frame member, and wherein the one of the plurality of shelves comprises a slide support structure constructed and arranged to retain at least a portion of the frame member to connect the first slide member to the one of the plurality of shelves.

15. The shelving system of claim 14, wherein the frame member comprises a slideable connector member constructed and arranged to be slideable between a) a locked position wherein the slideable connector member is retained on the slide support structure to connect the frame member and the first slide member to the one of the plurality of shelves and b) an unlocked position wherein the slideable connector member is released from the slide support structure to disconnect the frame member and the first slide member from the one of the plurality of shelves.

16. The shelving system of claim 14, wherein the frame member comprises a hook constructed and arranged to be retained on the slide support structure to connect the frame member and the first slide member to the one of the plurality of shelves.

17. The shelving system of claim 13, wherein the one of the plurality of shelves comprises a slide support structure constructed and arranged to retain at least a portion of the first slide member to connect the first slide member to the one of the plurality of shelves.

18. The shelving system of claim 13, wherein the drawer comprises a base and a plurality of side walls, and wherein at least one of the plurality of side walls is pivotally connected to the base and at least one other of the plurality of side walls is connectable to the base and/or other side walls via a snap-fit connection.

* * * * *